US005988926A

United States Patent [19]

Kiyomi

[11] Patent Number: 5,988,926

[45] Date of Patent: Nov. 23, 1999

[54] FILING DEVICE

[75] Inventor: Takio Kiyomi, Kyoto, Japan

[73] Assignee: Kokuyo Co., Ltd., Osaka, Japan

[21] Appl. No.: 08/944,866

[22] Filed: Oct. 6, 1997

Related U.S. Application Data

[63] Continuation-in-part of application No. 08/553,273, filed as application No. PCT/JP95/00983, May 22, 1995.

[51] Int. Cl.[6] ..... B42F 3/00

[52] U.S. Cl. ..... 402/70; 402/73; 402/46; 281/36

[58] Field of Search ..... 402/46, 47, 48, 402/55, 56, 70, 73, 75; 281/36, 21.1

[56] References Cited

U.S. PATENT DOCUMENTS

| | | | |
|---|---|---|---|
| 3,175,847 | 3/1965 | McKowen | 281/36 |
| 4,113,394 | 9/1978 | Giulie | 402/46 |
| 5,127,755 | 7/1992 | Bee | 402/48 |
| 5,445,468 | 8/1995 | Pacione | 402/73 |
| 5,634,732 | 6/1997 | Ushirooka et al. | 402/46 |

FOREIGN PATENT DOCUMENTS

| | | |
|---|---|---|
| 37-15819 | 6/1962 | Japan . |
| 37-32306 | 12/1962 | Japan . |
| 39-1408 | 1/1964 | Japan . |
| 39-33084 | 11/1964 | Japan . |
| 39-35164 | 11/1964 | Japan . |
| 42-11203 | 6/1967 | Japan . |
| 43-5700 | 3/1968 | Japan . |
| 51-161218 | 12/1976 | Japan . |
| 63-21079 | 2/1988 | Japan . |
| 1-97979 | 6/1989 | Japan . |
| 2-277-484 | 2/1994 | United Kingdom . |
| 93/24335 | 9/1993 | WIPO . |
| 94/25290 | 10/1994 | WIPO . |
| 94/25291 | 10/1994 | WIPO . |

*Primary Examiner*—Willmon Fridie, Jr.
*Attorney, Agent, or Firm*—Banner & Witcoff, Ltd.

[57] ABSTRACT

The filing device in which a binding fastener 2 fixedly attached to a folder body 1 can be demounted from the folder body 1 with accompanying plastic deformation or destruction of the parts of the filing device, and is characterized by that the binding fastener 2 is fixedly attached to the folder body 1 by a binding mechanism 3 which fastens the binding fastener 2 to the folder body 1 and which enables the binding fastener 2 to be released from the folder body 1 with a relative movement of the binding fastener 2 to the folder body 1, and an engaging lock mechanism 4 which prohibits the relative movement.

13 Claims, 17 Drawing Sheets

FILING DEVICE

This application is a continuation-in-part application of prior U.S. application No. 08/553,273 filed Nov. 16, 1995, abandoned, which is a filing under 35 U.S.C. § 371 of International application PCT/M95/00983, filed May 22, 1995.

FIELD OF THE ART

This invention relates to a filing device for a binder or a file suitable for storage or keeping in such a manner that the papers or sheets can easily be attached to or removed from by means of a binding fastener fixed to the inside of the filing device.

BACKGROUND ART

The filing device of this kind conventionally comprises a folder body having a front cover, a back cover and a rear cover, and a binding fastener fixed to the inner face of the back cover by, for example, rivets. The folder body is made of rigid sheet material such as cardboard or synthetic plastics and the binding fastener is of a sheet metal or rigid synthetic plastics. The binding fastener made of metal is fixed to the folder body made of paper or synthetic resin by means of a rivet made of metal and is so structured not to easily be demounted from the folder body by the weight of the bound papers.

Concern over the global ecological issues has recently been growing. Considering such a social trend, when products are to be disposed, the products are beginning not just to be incinerated but treated as follows; first broken apart into each parts of the same material, then collected according to the parts classified based on whether the material is reusable or not, or whether the material should be burned or not, and finally provided with a treatment according to each of the material for the reuse of the material of the products.

For the above-mentioned filing device when it is to be disposed, the binding fastener and the rivet made of metal is reusable if collected and melted, and the folder body made of paper is reusable as a recycled paper if collected. However, if the binding fastener is securely fixed to the folder body by the rivet, the filing device may not be divided into different material on the spot where the filing device has been used, thereby to cause difficult collection of the parts according to the material. That is, there is no other way but to plastically deform the rivet by means of a tool such as a drill or the like for demounting the binding fastener from the folder body. In offices where the filing devices are used or kept it is rare to ordinarily be furnished with the above-mentioned tools so that it may be costly to purchase the tool just for the disposal of the filing device, which makes it difficult to separate and collect the filing device according to the material as mentioned above. In addition, if the operation to separate the filing device accompanies too much trouble, it may not be conducted because it is not obligatory to separate and collect the filing device. There is also a problem that it involves risks to separate the filing device by using the tools like a drill.

The present invention has been accomplished to solve the above-mentioned problems. The object of the invention is to provide a filing device having such a structure that the binding fastener can be separated from the folder body without using a tool which is not ordinarily furnished.

DISCLOSURE OF THE INVENTION

To attain the above-mentioned object the invention has adopted the following structures. The filing device in accordance with the invention is a filing device in which a binding fastener fixedly attached to a folder body can be demounted from the folder body with accompanying plastic deformation or destruction of the parts of the filing device, and is characterized by that the binding fastener is fixedly attached to the folder body by a binding mechanism which fastens the binding fastener to the folder body and which enables the binding fastener to be released from the folder body by a relative movement of the binding fastener to the folder body, and an engaging lock mechanism which prohibits the relative movement.

The filing device in accordance with the invention includes the one which binds sheet material such as papers or the like by inserting a pipe-shaped member into a hole provided on the neighborhood of the side edge of the sheet material or by holding the sheet material between binding fasteners. The sheet material may include sum papers or continuous papers of a predetermined size, bags of synthetic resin which can accommodate floppy disks or compact disks or the like, and a sheet of synthetic resin. The folder body of these filing device is representatively of card board, but may be a sheet of plate-shaped. The folder body may be of synthetic resin other than of paper. The binding fastener may have such a structure that a hole is formed on the object to be bound and a pipe or a ring or the like are inserted into the hole or that one end of the object to be bound is pressed from the face thereof to the folder body. The binding fastener may be of metal or synthetic resin according to the weight of the amount of the object to be bound.

The binding mechanism in accordance with the invention binds the folder body and the binding fastener with supporting the load acting on the binding fastener while the engaging lock mechanism prohibits the folder body and the binding fastener from relative movement, and makes it possible to demount the binding fastener from the folder body when the prohibition of the relative movement is released. To bind does not mean to fix the binding fastener to the folder body semi permanently but means to maintain the condition of fixation or fixedly attachment under a predetermined condition. The engaging lock mechanism does not necessarily have such a high rigidness as the binding mechanism does because it does not support the load acting essentially on the binding fastener but just prohibits the relative movement. The relative movement in accordance with the invention means the movement perpendicular to a face where the folder body and the binding fastener are bound or the parallel movement horizontal to the above-mentioned face. The relative movement is preferably toward other direction than that of the load acting. In this case the movement may draw straight or curve.

The binding mechanism is preferably represented by;

(1) that comprising a mounting hole provided either one of the folder body or the binding fastener and having a small-circular portion and a big-circular portion arranged continuously to the small-circular portion, a through hole provided on the other and having a diameter corresponding to the small-circular portion, and a rivet passing through both of the through hole and the small-circular portion, (2) wherein instead of the mounting hole comprising the small-circular portion and the big-circular portion, the mounting hole comprises a rivet through portion and a cross slit portion having a slit for easy destruction arranged continuously to the rivet through portion, (3) that comprising a hook-shaped bent portion provided either one of the folder body or the binding fastener and an engaging hole provided on the other, wherein the hook-shaped bent portion inserted into the engaging hole is brought into engagement with an opening edge of the engaging hole by the relative movement of the folder body to the binding fastener, (4) that comprising a bent member passing through the folder body and projecting out of the inner face thereof and which is provided on a fixing plate arranged along the outer face of the folder body, and an engaging hole provided on the binding fastener, wherein the bent member is brought into engagement with the engaging hole by the relative movement of the folder body to the binding fastener, and (5) that comprising a pair of guide holders provided on both up and down edges of the fixing plate arranged along the folder body and which pass through the folder body and project from the inner face thereof, and an abutting member which is provided on one longitudinal side of the fixing plate and which passes through the folder body and project from the inner face thereof wherein both of the up and down edges of the fixing plate is brought into engagement with the abutting member.

In combination with the above binding mechanism (1), (2), and (3), the engaging lock mechanism is preferably represented by that comprising an engaging hole provided on the folder body and a stopper provided on the binding fastener with the front bent portion thereof inserted into the above-mentioned engaging hole. The stopper may be an oblong member with its free end just bent, or a curved-wall-shaped member having a semicircular free end and a front bent portion elongated from the edge of the semicircular free end. In this case the front bent portion is brought into engagement with a circular locking hole. In case the binding fastener is of synthetic resin, an elastically transformable stopper is provided with a thick portion at its tip, which makes engagement with a locking hole provided on the folder body. The engaging lock mechanism may also be represented by that comprising a locking hole provided on the folder body, a through hole provided on the binding fastener, a stopper engaged with the locking hole with a head portion thereof engaged with an opening edge of the through hole and with a leg portion passing through the through hole, and a stopper engaging portion which prohibits the stopper from being pulled out by engaging with the head portion when the stopper rotates.

The engaging lock mechanism to be combined with the binding mechanism in the above-mentioned (4), or (5) preferably comprises an engaging hole provided on the binding fastener, a through hole providing on the folder body corresponding to the engaging hole, and a stopper provided on the fixing plate and which makes engagement with the engaging hole by passing through the through hole.

In accordance with the arrangement, while the engaging lock mechanism is functioning, i.e. the folder body and the binding fastener are prohibited from relative movement, the folder body and the binding fastener are fastened by the binding mechanism and papers or the like can be bound by means of the binding fastener. If the engaging lock mechanism is halted to function in this state, the folder body and the binding fastener are brought into a movable condition relative to each other. More specifically, although the folder body and the binding fastener are bound by the binding mechanism, the state in which the folder body and the binding fastener are bound can be released by the relative movement of the folder body to the binding fastener. That is, when the binding fastener is to be demounted from the folder body, halt in the function of the engaging lock mechanism makes it possible to release the binding fastener from the folder body without plastically deforming or destroying the binding mechanism which binds the binding fastener. As a result of this, the binding fastener can be demounted from the folder body without plastically deforming or destroying the binding mechanism which essentially fastens the binding fastener to the folder body. Then the folder body and the binding fastener can be separated without accompanying troublesome or risky operation, thereby to be recycled or effectively disposed.

BEST MODES OF EMBODYING THE INVENTION

An embodiment of the invention will now be described with reference to FIG. 1 through 7.

Figure 1:
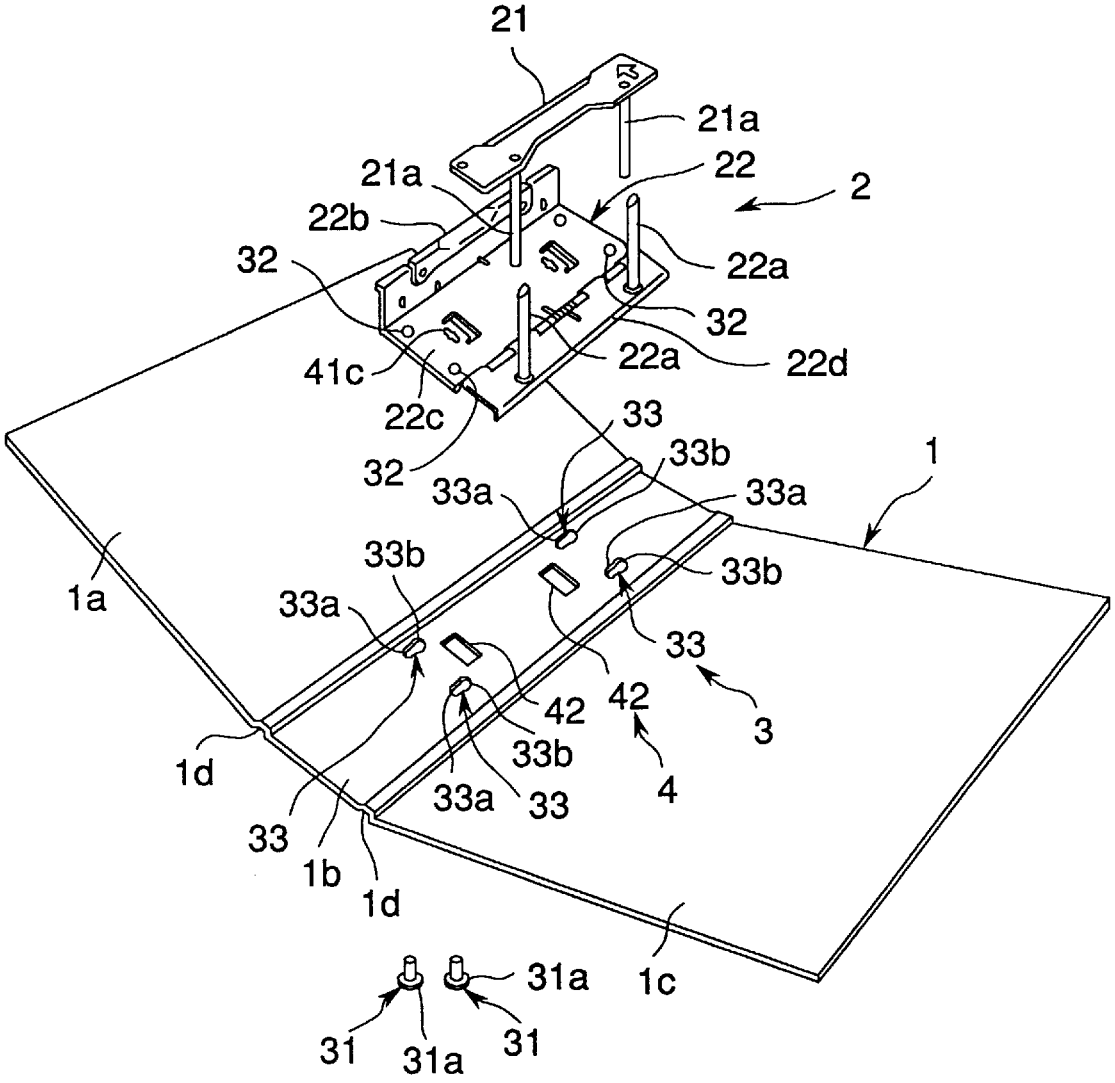
FIG. 1 is an exploded perspective view showing a preferred embodiment of this invention.
Figure 2:
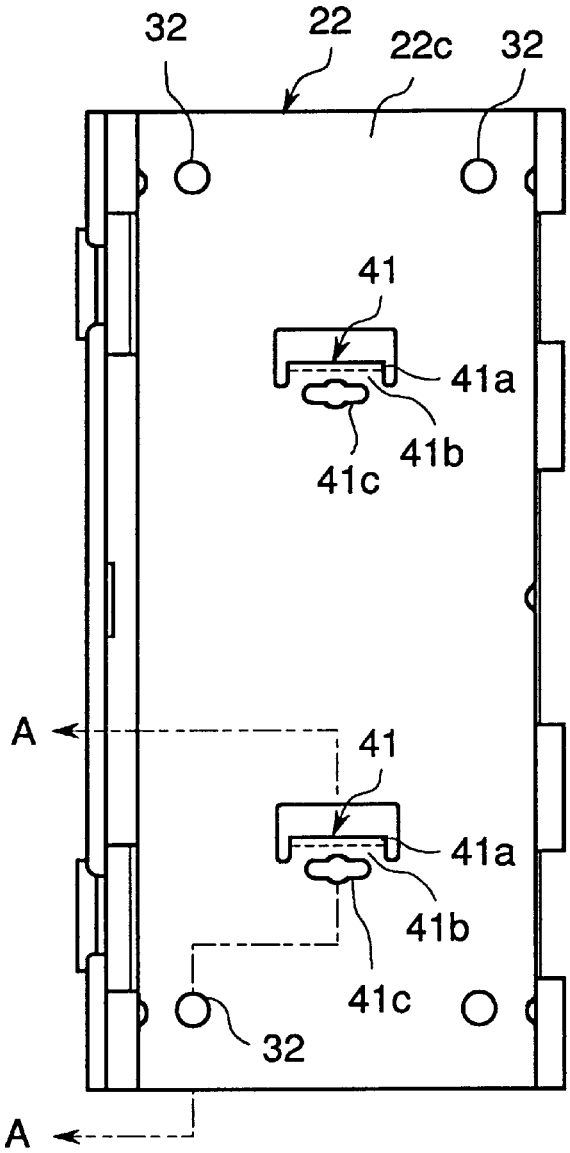
FIG. 2 is a plane view showing the principal portion of the embodiment.
Figure 3:
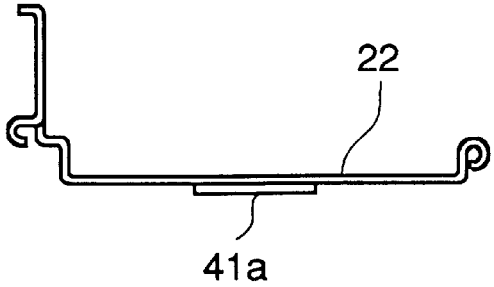
FIG. 3 is a front view showing the principal portion of the embodiment.

The filing device showed in FIG. 1 comprises a folder body 1, and a binding fastener 2 which is securely attached to the inner face, namely back face of the folder body 1. The folder body 1 is made of a sheet of cardboard, and has a front cover 1*a*, a back cover 1*b*, and a rear cover 1*c*. Hinge sections 1*d* concaved from a front face toward a rear face are formed along the boundary between the back cover 1*b* and the front cover 1*a* and between the back cover 1*b* and the rear cover 1*c* for easy folding the front cover 1*a* and the rear cover 1*c*. The binding fastener 2 is fixedly attached to the inner face of the back cover 1*b* at the longitudinal center thereof by a binding mechanism 3 and an engaging lock mechanism 4 to be described hereinafter.

The binding fastener 2 is well known in the art and has such an arrangement that papers are bound by a pair of pipe-shaped binding rods 22*a* into which a sliding rod 21*a* can be removably inserted. That is, the binding fastener 2 comprises a base member 22 fixedly attached to the folder body 1 under a predetermined condition by both the binding mechanism 3 and the engaging lock mechanism 4, a movable side plate 22*d* pivotally connected to the base member 22 and having a pair of binding rods 22 projected on the inside thereof, and a clamp member 21 removably mounted to the above-mentioned binding rod 22*a* by the sliding rod 21*a*. The arrangement for binding papers to the base member 22 in coaction with the binding rod 22*a* and the clamp member 21, and a locking device 22*b* for locking the clamp member 21 to the base member 22 or the like may be the same as well known in the art. Accordingly, no further explanation to the arrangement is given here.

The base member 22 in accordance with the embodiment is of a suitable sheet metal. On a mounting member 22*c* of the base member 22 provided are a through hole 32 as the binding mechanism 3 into which a rivet 31 is inserted and a stopper 41 as the engaging lock mechanism 4 whose front is bent to form a front bent portion 41*a*. The through hole 32 is a small circle-shaped hole having generally the same in diameter as the rivet 31 and is arranged at a location in the neighborhood of each of the four corners of the rectangular mounting member 22*c*. The stopper 41 is formed near upside and downside at the center of the width on the mounting member 22*c* with a base portion 41*b* of a small member cut out from the mounting member 22*c* kept flat to the mounting member 22*c* and a tip thereof bent toward the folder body 1. A release hole 41*c* is formed on the base portion 41*b* of the stopper 41 for inserting a screwdriver or the above-mentioned sliding rod 21*a* if necessary to fold and bend the stopper 41 upwardly. More specifically, the release hole 41*c* comprises an oval hole whose longitudinal direction is parallel to the front bent portion 41*a* corresponding to the minus screwdriver to be inserted and a circle hole which is arranged at generally the center of the oval hole and into which the sliding rod 21*a* of the clamp member 21 can be inserted for folding and bending the stopper 41 without a screwdriver.

Corresponding to the base member 22 having the above-mentioned arrangement, the back cover 1*b* of the folder body 1 is provided with a mounting hole 33 as the binding mechanism 3 and an engaging hole 42 as the engaging lock mechanism 4. The mounting hole 33 comprises a small-circular portion 33*a* having generally the same diameter as the rivet 31 and a big-circular portion 33*b* continuously arranged to the small-circular portion 33*a* to form a keyhole shape. The mounting hole is not limited to the shape of the keyhole but may comprise, for example, a big portion having a shape of oval and a small portion elongated from one end of the big portion toward the direction perpendicular to the longitudinal direction of the big portion. The big-circular portion 33*b* has such a diameter that the head 31*a* of the rivet 31 can easily pass therethrough. In this embodiment the mounting hole 33 is so arranged that the big-circular portion 33*b* is positioned upside when the filling device is in use. As a result of this arrangement of the mounting hole 33, the rivet 31 is prevented from moving toward the big-circular portion 33*b* even though a relatively big load acts on the binding fastener 2 in ordinal use. The engaging hole 42 is rectangular in shape and arranged so that the front bent portion 41*a* of the stopper 41 makes abutting engagement with one of the inner wall faces 42*a* of the locking hole 42 when the base member 22 is bound to the folder body 1. More particularly, the locking hole 42 has a wider width than that of the stopper 41 and is so arranged to form the inner wall face 42*a* with which the front bent portion 41*a* makes abutting engagement when the binding fastener 2 is positioned where it is to be fixed.

Figure 4:
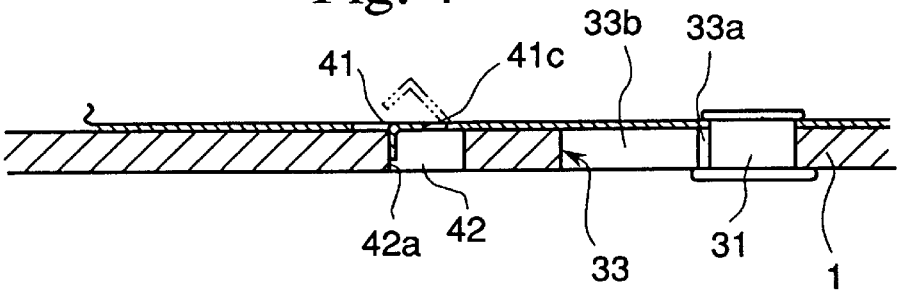
FIG. 4 is a sectional view taken along line A—A of FIG. 2, FIGS. 5 to 7 show processing steps to dispose the filing device of the embodiment.

The binding fastener 2 is fixedly attached to the folder body 1 by the rivet 31 and the stopper 41 serves to prevent the binding fastener 2 from moving from the fixed position. More particularly, for fixing the binding fastener 2 to the folder body 1, first bring the base member 22 into coincidence with the folder body 1. At this time align the center of the through hole 32 formed on the base member 22 with that of the small-circular portion 33*a* of the mounting hole 33 formed on the folder body 1 to make them concentric. When the alignment has been completed, the stopper 41 comes into abutting engagement with the inner wall face 42*a* of the locking hole 42, thereby to prohibit the binding fastener 2 from moving toward the big-circular portion 33*b* of the mounting hole 33. Insert the rivet 31 into each of four small-circular portions 33*a* of the mounting hole 33 and the corresponding through hole 32 until the rivet 31 passes through them and then rivet the tip of the rivet 31 projecting from the through hole 32 (as shown in FIG. 4). With the tip of the rivet 31 riveted, the binding fastener 2 is fixedly attached to the folder body 1 by the same strength as the conventional filing device. In the fixed state the binding fastener 2 does not move along the folder body 1 because of the riveting force by the rivet 31 unless relatively big external force is applied thereto. The binding fastener 2 is prohibited from moving without fail because the front bent portion 41*a* of the stopper 41 makes abutting engagement with the inner wall face 42*a* of the locking hall 42. More specifically, although the binding fastener 2 moves along the inner face of the folder body 1 when the predetermined condition is satisfied, the binding fastener 2 is riveted to the folder body 1 and most of the load applied to the binding fastener 2 is sustained by the rivet 31 when in use.

Figure 5:
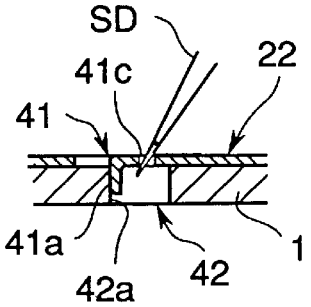
Figure 6:
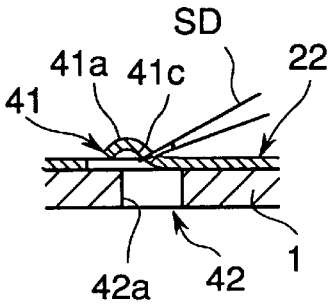
Figure 7:
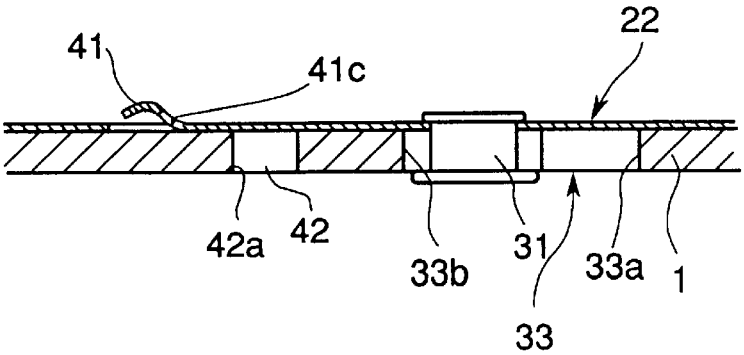

With the above-described arrangement of the filing device, the binding fastener 2 can be demounted from the folder body 1 when the filing device becomes unnecessary. For demounting the binding fastener 2, as shown in FIG. 5 through FIG. 8, first plastically deform, namely, bend the stopper 41 upwardly to the base member 22 to make the front bent portion 41*a* project out of the locking hole 42. Insert the tip of the screwdriver SD into the release hole 41*c* and lift the tip thereof for bending the stopper 41 (as shown in FIG. 5 and 6). Then the binding fastener 2 comes into a movable condition toward the big-circular portion 33*b* of the mounting hole 33 along the inner face of the folder body 1. Hold the folder body 1 with one of the hands so as not to travel, and move the binding fastener 2 toward the big-circular portion 33*b* with another hand, thereby to bring the head 31*a* of the rivet 31 into coincidence with the big-circular portion 33*b* (as shown in FIG. 7). As the head 31*a* of the rivet 31 is smaller in diameter than the big-circular portion 33*b*, the binding fastener 2 can be demounted from the folder body 1 if the binding fastener 2 is moved upwardly perpendicular to the inner face of the folder body 1. In this case the rivet 31 which has fixed the binding fastener 2 to the folder body 1 attaches to the demounted binding fastener 2 without being destroyed or plastically deformed.

As the binding fastener 2 can be demounted just by moving the binding fastener 2 relatively to the folder body 1 after the stopper 41 provided on the base member 22 is bent, each parts of different material can easily be separated, collected and disposed according to the material. More specifically, the binding fastener 2 of metal and the folder body 1 of paper can be brought into a condition that is ready for easy removal without using any special tool, resulting in easy removal operation for anybody. This in turn essentially eliminates the time required for separation according to the material and disposal of the filing device, thereby to promote the effective utilization of the resource.

Figure 8:
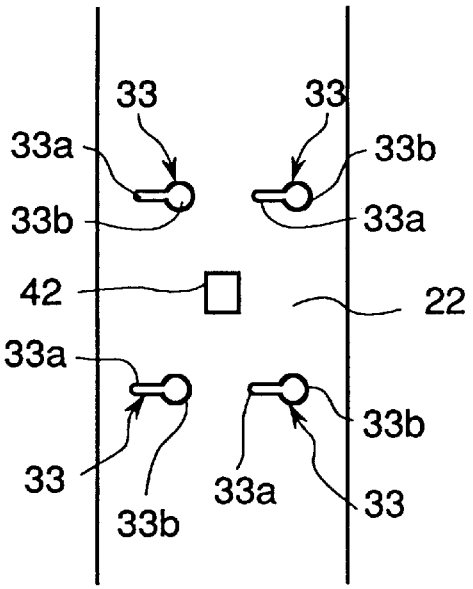
FIG. 8 is a plane view showing an arrangement of the hole in the binding mechanism according to another preferred embodiment of this invention.

Referring to FIG. 8, a filing device according to the second embodiment of the invention will now be described.

This embodiment is different from the embodiment previously described in the arrangement of the mounting hole 33 of the binding mechanism 3. In this embodiment, the arrangements other than that of the mounting hole 33 are essentially the same as those of the above embodiment. Therefore, the same reference number is given to the same element in the drawings and no description will be given.

Unlike in the above embodiment, in the second embodiment the mounting hole 33 of the binding mechanism 3 is, as shown in FIG. 8, so arranged that the binding fastener 2 is to be moved toward the direction of left or right relatively to the folder body 1. More specifically, the small-circular portion 33*a* is formed on the left side of the mounting hole 33 and the big-circular portion 33*b* is continuously formed on the right side of the small-circular portion 33*a*.

Figure 9:
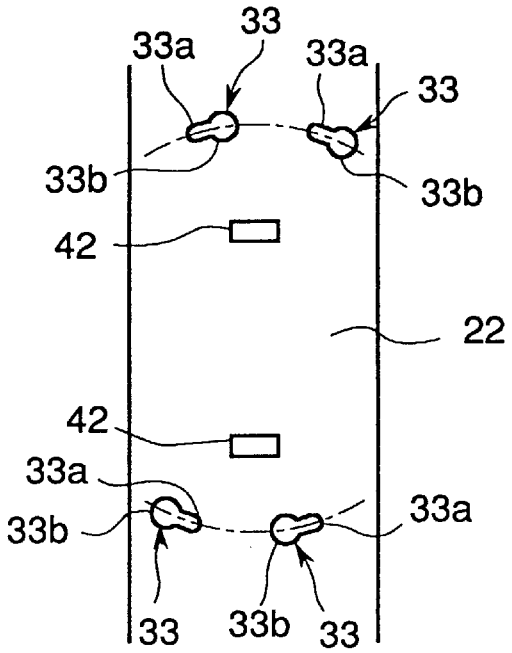
FIG. 9 is a plane view showing an arrangement of the hole in the binding mechanism according to further preferred embodiment of this invention.

Referring to FIG. 9, the third embodiment of the invention will now be described.

The third embodiment is different from the first and second embodiments in the arrangement of the mounting hole 33 of the binding mechanism 3.

Unlike in the above embodiment, in the third embodiment the mounting hole 33 of the binding mechanism 3 is, as shown in FIG. 9, so arranged that the binding fastener 2 is to be rotated around the center of the base member 22 relatively to the folder body 1. More specifically, four small-circular portions 33*a* are arranged along the arc of the circle whose center coincides with that of the base member 22, where the big-circular portion 33*b* is arranged continuous to the right side of the small-circular portion 33*a* which locates upside while the big-circular portion 33*b* is arranged continuous to the left side of the small circular portion 33*a* which locates downside. In this embodiment, there are two locking holes 42 with each of which the stopper 41 makes engagement to prevent the binding fastener 2 from rotating.

Figure 10:
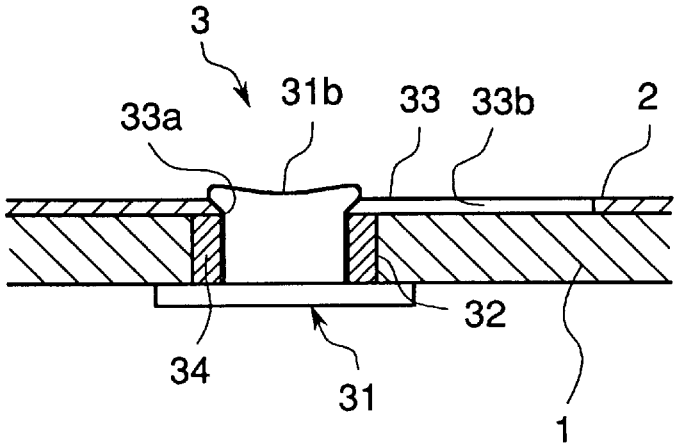
FIG. 10 is a sectional view showing the binding mechanism according to further preferred embodiment of this invention.

Referring to FIG. 10, the forth embodiment of the invention will now be described.

This embodiment is different from the embodiments previously described in the binding mechanism 3. In this embodiment the binding mechanism 3 is, as shown in FIG. 10, the mounting hole 33 is formed on the binding fastener 2 and the through hole 32 is formed on the folder body 1. In this case, it will dampen the significance of separating the folder body 1 from the binding fastener 2 if the rivet 31 made of metal as binding mechanism 3 remains to attach to the folder body 1 made of paper. Accordingly, the diameter of the through hole 32 is preferably made generally the same as that of the riveted portion of the rivet 31. More specifically, the through hole 32 formed on the folder body 1 is so made in diameter that the riveted portion of the rivet 31 can pass therethrough. As the riveted portion of the rivet 31 can easily pass through the through hole 32 having such a diameter, a ring-shaped bush 34 whose inner diameter generally equals to the outer diameter of the rivet 31 and whose outer diameter generally equals to the diameter of the through hole 32 is provided to surround the rivet 31. The rivet 31 is inserted into the through hole 32 from the direction of the outer face of the folder body 1 by the bush 32 and one end 31*b* which passes through the small-circular portion 33*a* of the mounting hole 33 is riveted. With the above-described arrangement of the filling device, the rivet 31 can be demounted from the folder body 1 together with the bush 34. Now referring to FIG. 11 through FIG. 13, the fifth embodiment of the invention will now be described.

This embodiment is different from the embodiment previously described in the engaging lock mechanism 504 and other arrangements are essentially the same as those of the first embodiment. Therefore, the same reference number is given to the same element in the drawings and no description will be given.

Figure 11:
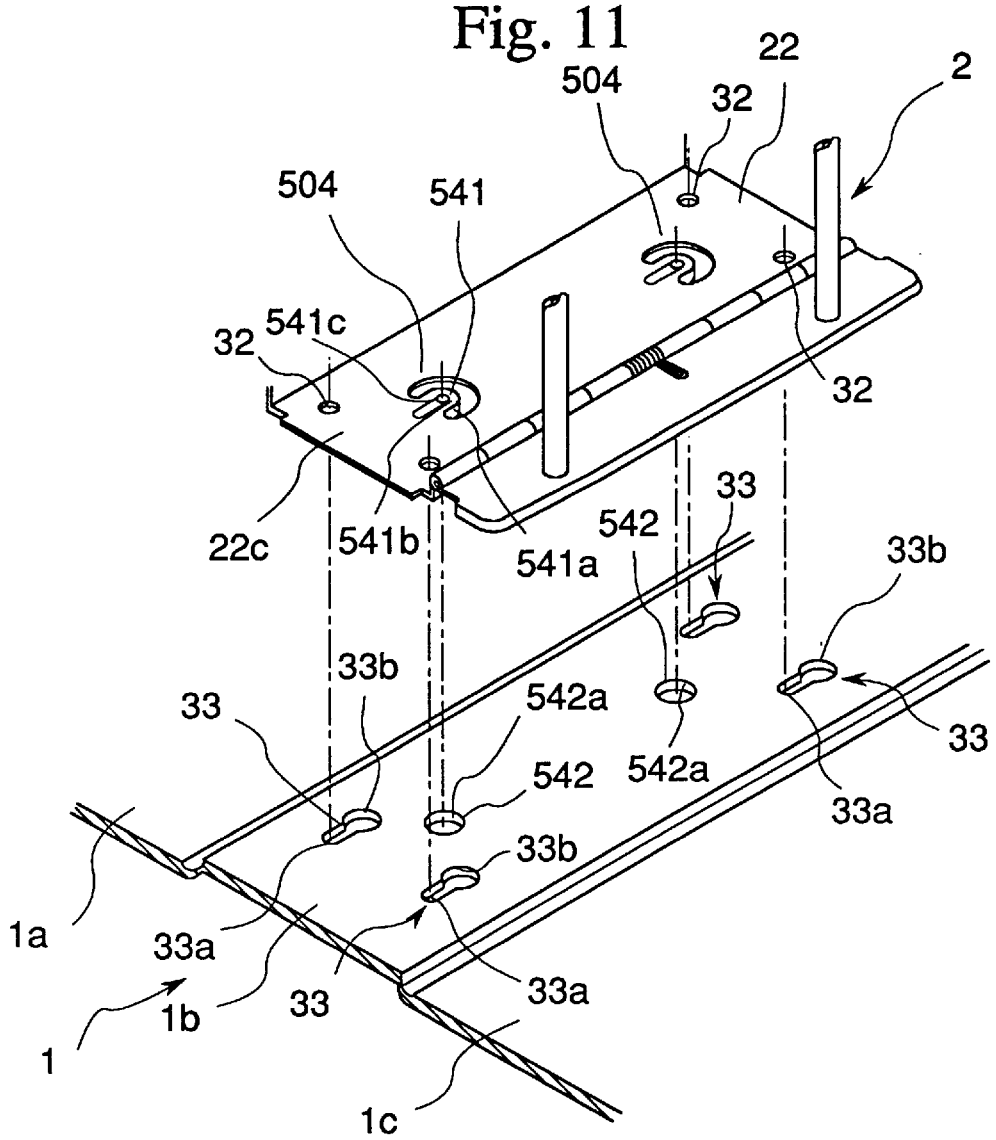
FIG. 11 is a perspective view showing the engaging lock mechanism according to further preferred embodiment of this invention.
Figure 12:
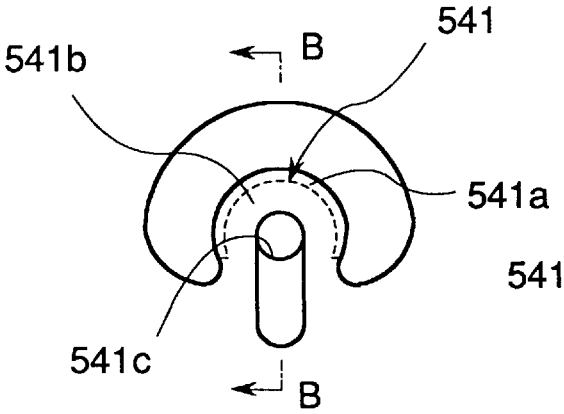
FIG. 12 is a plane view showing the principal portion of the embodiment.
Figure 13:
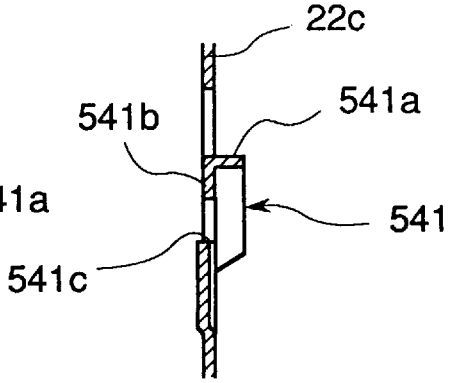
FIG. 13 is a sectional view taken along line B—B of FIG. 12.

In the fifth embodiment, the engaging lock mechanism 504 comprises, as shown in FIG. 11 through FIG. 13, a stopper 541 having a base portion 541*b* whose free end is generally semicircular-shaped and a curved-wall-shaped front bent portion 541*a* elongated from the edge of the semicircular-shaped free end, and a circular-shaped locking hole 542.

More specifically, there are two stoppers 541, and each stopper 541 is formed at the center of the width and at the neighborhood of upside and downside edges on the mounting member 22*c*. The base portion 541*b* is formed to be flat to the mount member 22*c*. The edge of the free end is elongated toward the folder body 1 to make the front bent portion 541*a*. The front bent portion 541*a* is a generally semicircular-shaped wall and makes abutting engagement with the inner wall face 542*a* of the locking hole 542 so as to prohibit the binding fastener 2 from moving toward the big-circle portion 33*b* of the mounting hole 33 when the binding fastener 2 is mounted on the folder body 1. A release hole 541*c* is formed on the base portion 541*b* of the stopper 541 for inserting a sliding rod or the like to fold and bend the stopper 541 upwardly when necessary. The release hole 541*c* is of circular-shaped concentric with the stopper 541. A part of the mounting member 22*c* which is continuous to the release hole 541 is raised up for reinforcement.

The locking hole 542 is of circular shaped having a curved inner wall face 542*a* and formed on the back cover 1*b* of the folder body 1. The locking hole 542 is arranged at a position where the front bent portion 541*a* of the stopper 541 makes abutting engagement with the inner wall face 542*a* when the base member 22 is bound to the folder body 1. The diameter of the locking hole 542 is a little larger than that of the stopper 541.

With the above-described arrangement of the filing device, the binding fastener 2 can be attached to or demounted from the folder body 1 as the same as the above-mentioned embodiments. More specifically, for attaching the binding fastener 2 to the folder body 1, first bring the base member 22 into coincidence with the folder body 1 to align the center of the through hole 32 formed on the base member 22 with that of the small-circular portion 33*a* of the mounting hole 33 formed on the folder body 1. When the alignment has been finished, the stopper 541 makes abutting engagement with the inner wall face 542*a* of the locking hole 542, thereby to prohibit the binding fastener 2 from moving toward the big-circular portion 33*b* of the mounting hole 33. Next insert each of four rivets 31 into each small-circular portion 33*a* of the mounting hole 33 and the through hole 32 and then rivet the tip of the rivet 31 projecting from the through hole 32. For removing the binding fastener 2 from the folder body 1 when the filing device becomes unnecessary, first bend to plastically deform the front bent portion 541*a* of the stopper 541 upwardly to the base member 22 by means of a sliding rod or the like until the front bent portion 541*a* of the stopper 541 is released from the abutting engagement with the inner wall face 542*a*. The binding fastener 2 comes into a condition of being able to be moved toward the big-circular portion 33*b* of the mounting hole 33. Next move the binding fastener 2 to the folder body 1 until the rivet 31 is perfectly brought into coincidence with the big-circular portion 33*b*. Then demount the binding fastener 2 from the folder body 1.

With the above-described arrangement, the shape of the front bent portion 541*a* of the stopper 541 in the engaging lock mechanism 504 is a curved wall extending from the edge of the semicircular, resulting in improvement of the strength of the stopper 541 as well as the same effect produced as the above-mentioned embodiments.

Figure 14:
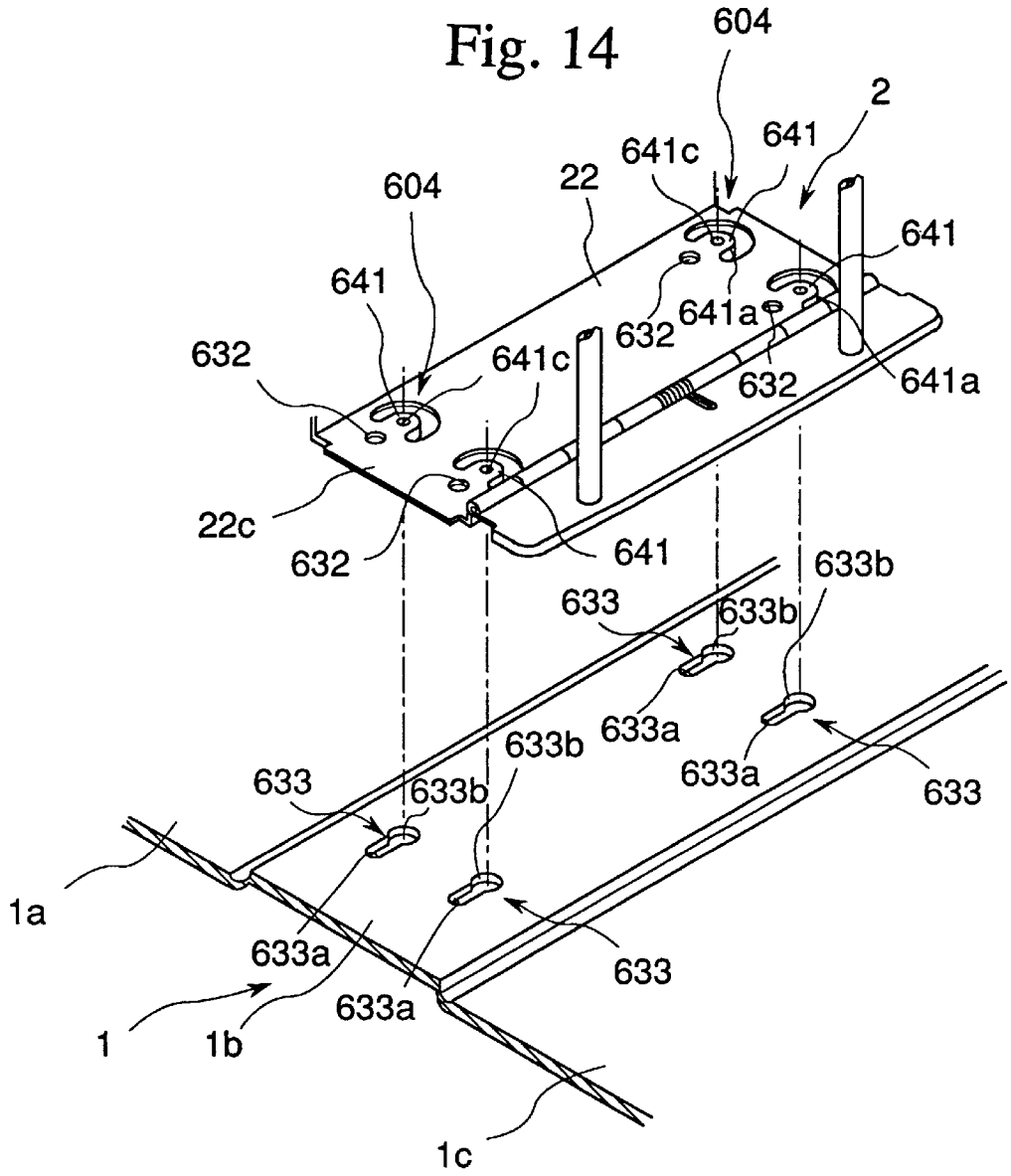
FIG. 14 is a perspective view showing the engaging lock mechanism according to further embodiment of this invention.
Figure 15:
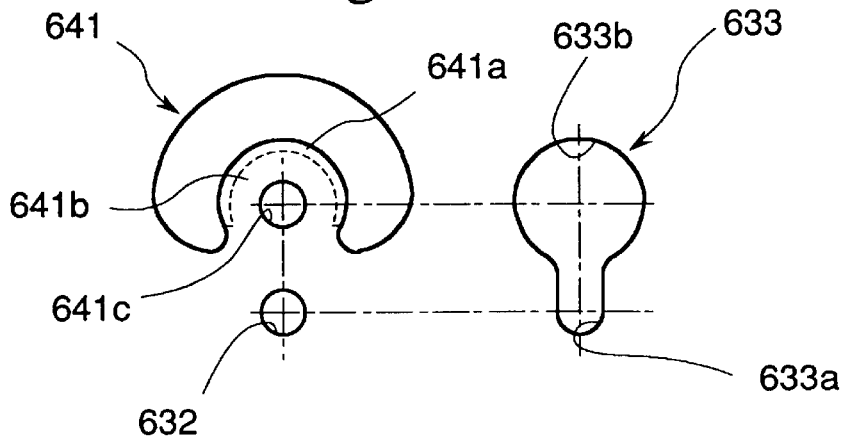
FIG. 15 is an explanatory view showing the principal portion of the embodiment.

Referring to FIGS. 14 and 15, the sixth embodiment of the invention will now be described.

The sixth embodiment is different from the embodiment previously described in the engaging lock mechanism 604 and other arrangements are essentially the same as those of the first embodiment.

In the sixth embodiment, as shown in FIGS. 14 and 15, the stopper 641 of the engaging lock mechanism 604 makes engagement with the big-circular portion 633*b* of the mounting hole 633 as the binding mechanism 603. More specifically, the mounting hole 633 is formed like the first embodiment on the back cover 1*b* of the folder body 1 and comprises a small-circular portion 633*a* having generally the same diameter as the rivet 31 and a big-circular portion 633*b* arranged continuous to the small-circular portion 633*a* to form a keyhole shape. The big-circular portion 633*b* is arranged upside to the small-circular portion 633*a* when the filling device is in use and at a position where the front bent portion 641*a* of the stopper 641 to be described hereinafter makes abutting engagement with the inner wall face thereof. The diameter of the big-circular portion 633*b* is a little larger than those of the head 31*a* of the rivet 31 and the stopper 641. The through hole 632 has generally the same diameter as the rivet 31 and is formed at a position to concentrate with the small-circular portion 633*a* when the base member 22 is bound to the folder body 1. The engaging lock mechanism 604 is, as shown in FIGS. 14 and 15, the same as that of the fifth embodiment and comprises a stopper 641 having a base portion 641*b* whose free end is generally semicircular-shaped and a curved-wall-shaped front bent portion 641*a* elongated from the edge of the semicircular free end, and a circular-shaped locking hole which makes engagement with the stopper 641 and formed on the back cover 1*b* of the folder body 1. The big-circular portion 633*b* functions as a locking hole and makes engagement with the stopper 641 when the base-member 22 is bound to the folder body 1.

In accordance with the arrangement, the binding fastener 2 can be attached to or demounted from the folder body 1 as the same as the above-described embodiments.

With the above-described arrangement, the big-circular portion 633*b* of the mounting hole 633 makes engagement with the stopper 641 while the base member 22 is bound to the folder body 1 and it can be a hole through which the head 31*a* of the rivet 31 passes when the base member 2 is to be demounted from the folder body 1, thereby it serves two different functions as well as to produce the same effect as the above-mentioned embodiments. Accordingly, the number of the holes formed on the folder body 1 can be diminished, resulting in lesser processing portions of the folder body 1.

Figure 16:
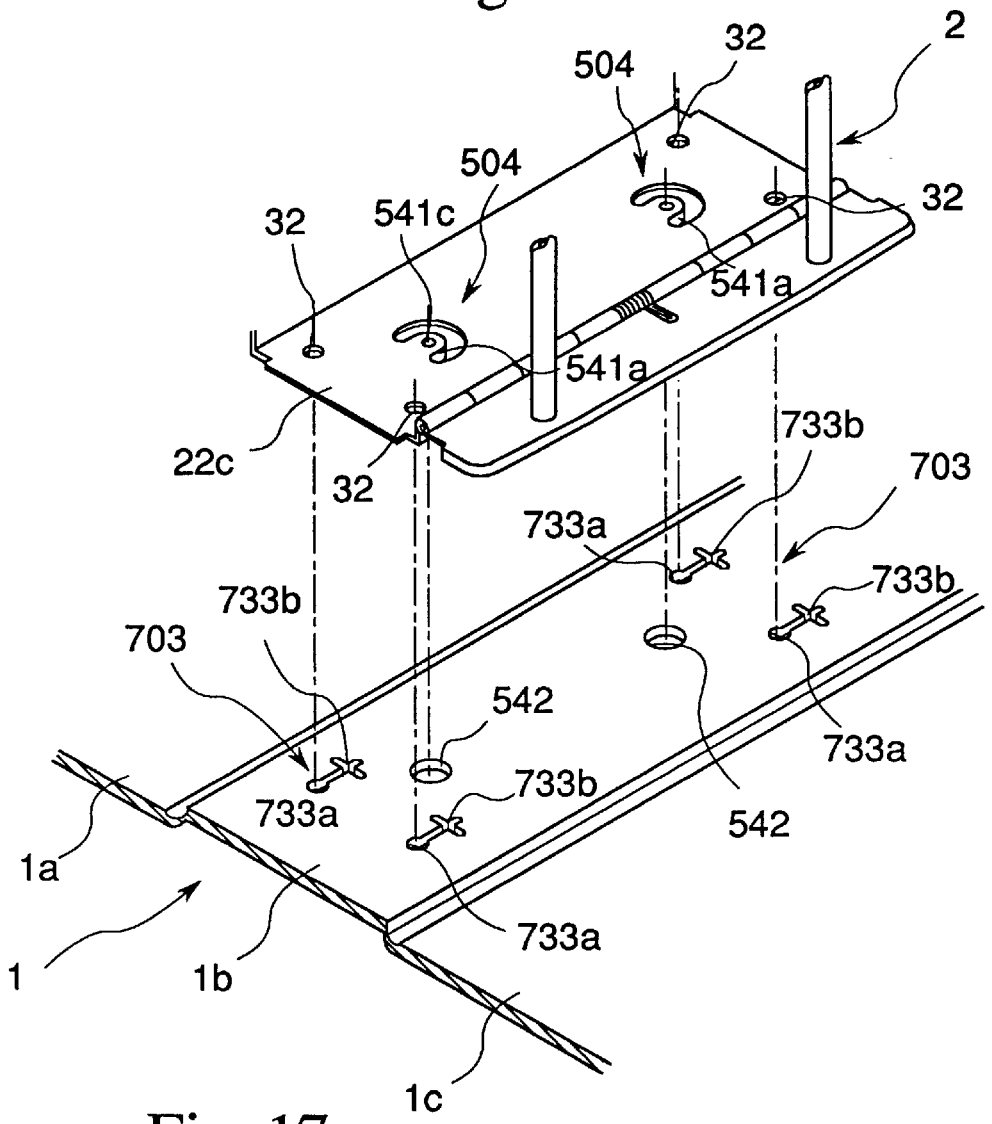
FIG. 16 is a perspective view showing the binding mechanism in accordance with further embodiment.
Figure 17:
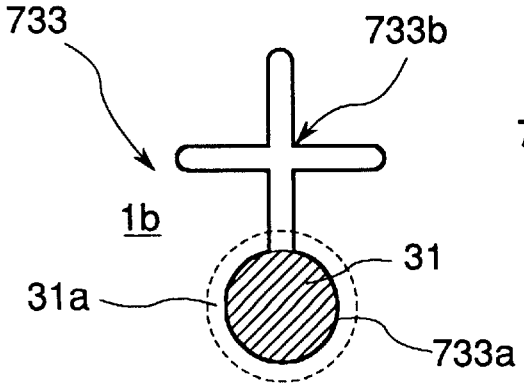
FIG. 17 is a sectional view showing the principal portion of the embodiment.
Figure 18:
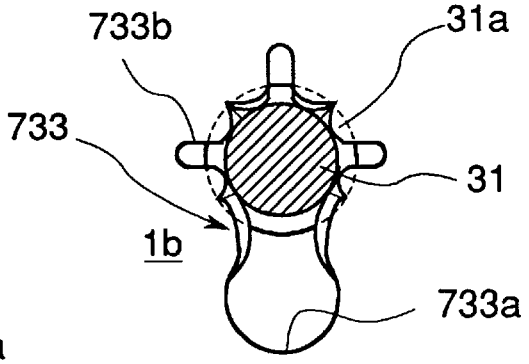
FIG. 18 is an explanatory view showing the function of the principal portion.

Referring to FIG. 16 through FIG. 18, the seventh embodiment of the invention will now be described.

The seventh embodiment is different from the fifth embodiment previously described in the binding mechanism 703 and other arrangements are essentially the same as those of the fifth embodiment. Therefore, the same reference number is given to the same element in the drawings and no description will be given.

In accordance with the seventh embodiment, the binding mechanism 703 comprises, as shown in FIG. 16 through FIG. 18, the mounting hole 733 formed on the folder body 1 and which has a rivet through portion 733*a* and a cross slit portion 733 which is arranged continuous to the rivet through portion 733*a*. The through hole 32 formed on the binding fastener 2 has a corresponding diameter to the rivet through portion 733*a*. More specifically, the mounting hole 733 comprises the rivet through portion 733*a* having generally the same diameter as the rivet 31 and the crossshaped cross slit portion 733*b* formed continuously upward to the rivet through portion 733*a* when the filing device is in use. The down end of the cross slit portion 733*b* is continuous to the rivet through portion 733*a* and so formed that the opening width thereof is quite smaller than the diameter of the rivet 31. Accordingly, the rivet 31 which is inserted into and passed through the rivet through portion 733*a* does not move toward the cross slit portion 733*b* unless the cross slit portion 733*b* is destroyed to form the diameter of an opening bigger than that of the rivet 31. In addition, the cross slit portion 733*b* has such a strength that it can be destroyed if a force bigger than the predetermined is applied thereto, and both of the width and the length are formed bigger than the diameter of the head 31 of the rivet 31 to form a hole having a diameter through which the head 31*a* of the rivet 31 can be passed when destroyed.

With the above-described arrangement, the binding fastener 2 can be attached to the folder body 1 as the same as the above-described fifth embodiment. When the filing device becomes unnecessary, first release the binding fastener 2 from being prohibited to move to the folder body 1 by the stopper 541 by means of a sliding rod or the like so as to make the binding fastener 2 in a condition that it can be moved toward the cross slit portion 733*b* of the mounting hole 733. Next destroy the back cover 1*b* around the cross slit portion 733*b* by applying a force bigger than the predetermined to the binding fastener 2 toward the cross slit portion 733*b*. Then move the binding fastener 2 to the folder body 1 until the center of the rivet 31 making engagement with the rivet through portion 733*a* is brought into coincidence with the cross portion of the cross slit portion 733b. The broken back cover 1*b* comes into a state of being able to be passed through by the head 31*a* of the rivet 31 by applying further force in the state shown in FIG. 18. Then the folder body 1 can be demounted from the binding fastener 2 together with the rivet 31 if the binding fastener 2 is demounted.

In accordance with the arrangement of the embodiment, the strength of mounting the binding fastener 2 to the folder body 1 can be improved as well as producing the same effect as the above-mentioned embodiments.

Figure 19:
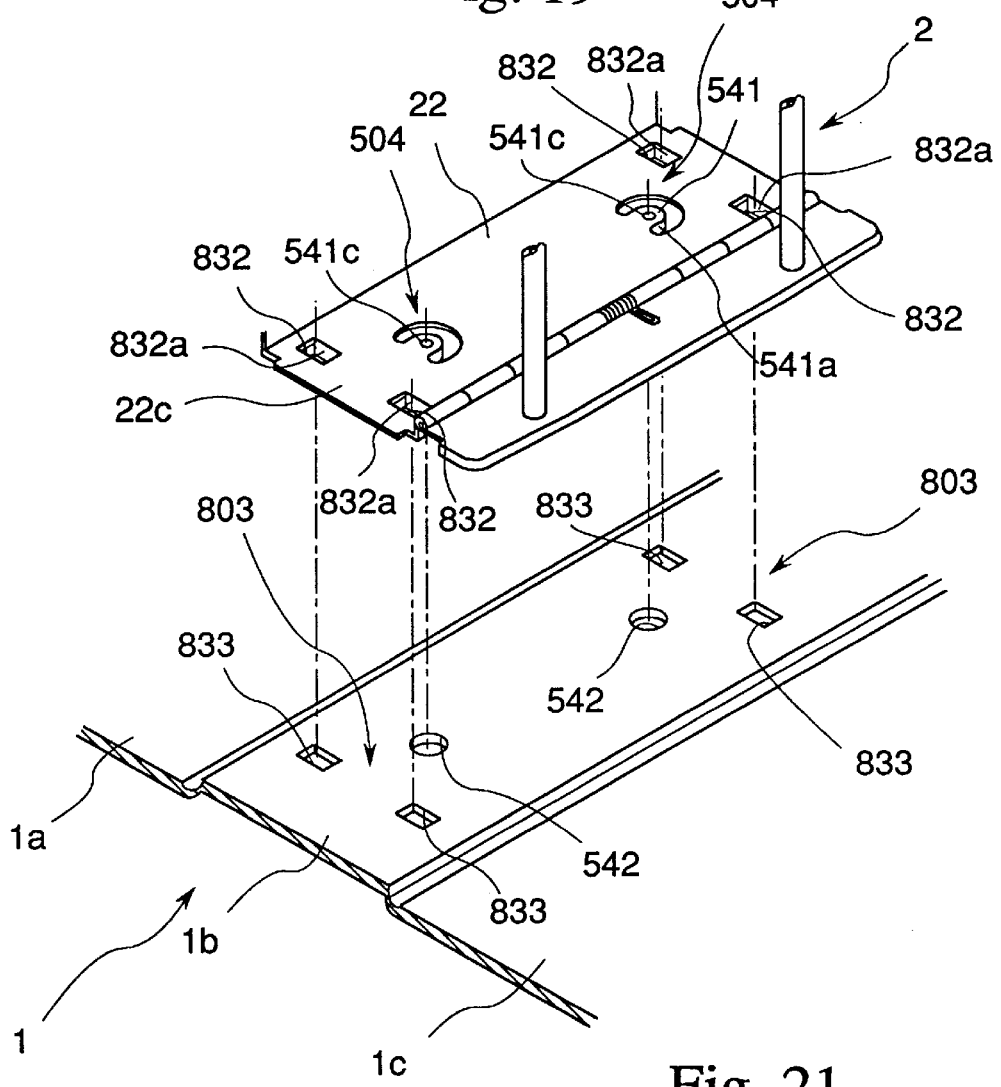
FIG. 19 is a perspective view showing the binding mechanism in accordance with further embodiment of this invention.
Figure 20:
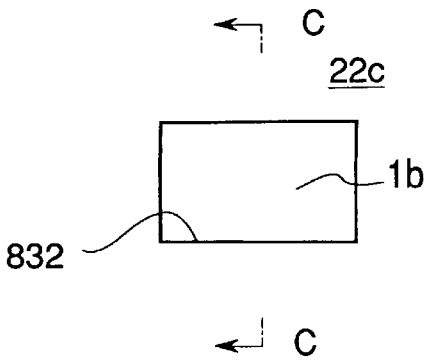
FIG. 20 is a plane view showing the principal portion of the embodiment.
Figure 21:
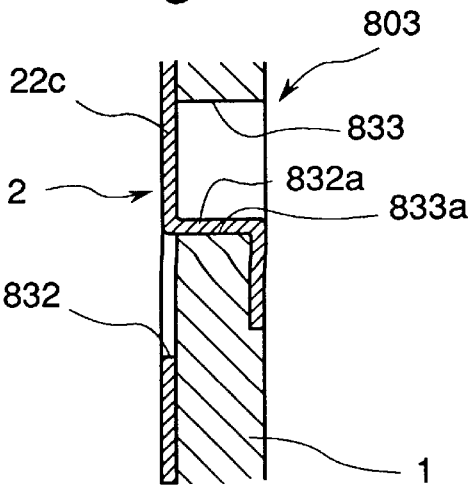
FIG. 21 is a sectional view taken along line C—C of FIG. 20.

Referring to FIG. 19 through 21, the eighth embodiment of the invention will now be described.

The eighth embodiment is different from the previously described embodiments in the binding mechanism 803 and other arrangements are essentially the same as those of the fifth embodiment. Therefore, the same reference number is given to the same element in the drawings and no description will be given.

In accordance with the eighth embodiments the binding mechanism 803 comprises, as shown in FIG. 19 through 21, a hook-shaped bent portion 832*a* provided on the mounting member 22*c* of the binding fastener 2 and an engaging hole 833 provided on the folder body 1. The binding mechanism 803 is so arranged that the hook-shaped bent portion 832*a* inserted into the engaging hole 833 comes into engagement with an opening edge 833*a* of the engaging hole 833 by the movement of the folder body 1 relative to the binding fastener 2.

More specifically, the hook-shaped bent portion 832*a* is formed to elongate the edge of the hole 832 which locates upper side when the filing device is in use toward the folder body 1 and to elongate the free end of the elongated edge downward when the filing device is in use. The hole 832 is formed at a location in the neighborhood of each of the four corners of the rectangular mounting member 22*c*. A square shaped engaging hole 833 is formed on the back cover 1*b* of the folder body at a position with which the hook-shaped bent portion 832*a* can make abutting engagement when the binding fastener 2 is bound to the folder body 1. The engaging hole 833 has a little larger opening width than that of the hook-shaped bent portion 832*a* so that the hook-shaped bent portion 832*a* can be inserted thereinto. The engaging hole 833 has an opening edge at the down side thereof when the filing device is in use. The hook-shaped bent portion 832*a* makes engagement with the opening edge 833*a* to bind the binding fastener 2 to the folder body 1. In addition, the part continuous to the opening edge 833*a* and to which the binding fastener 2 is to be attached is formed to have less thickness than that of the other face as much as generally the same as the thickness of the hook-shaped bent portion 832*a* to make the surface of the hook-shaped bent portion 832*a* flat to the other face when the hook-shaped bent portion 832*a* makes engagement with the folder body 1.

With the above-mentioned arrangement, for mounting the binding fastener 2 to the folder body 1, only insert the hook-shaped portion 832*a* into the engaging hole 833 to make engagement with the opening edge 833*a* of the engaging hole 833. In this state, the binding fastener 2 is prohibited from moving downwardly to the folder body 1 when the filing device is in use. In addition, as the stopper 541 is engaged with the locking hole 542 like the fifth embodiment, the binding fastener 2 is prohibited from moving upwardly along the folder body 1 when the filing device is in use, resulting in no fixing device like a rivet required for mounting the binding fastener 2 to the folder body 1. In accordance with the arrangement, no fixing device like a rivet is required to bind the binding fastener 2 to the folder body 1, thereby to require no time and labor for fixing by the fixing device., As a result of this, the process of mounting the binding fastener to the folder body is simplified.

Figure 23:
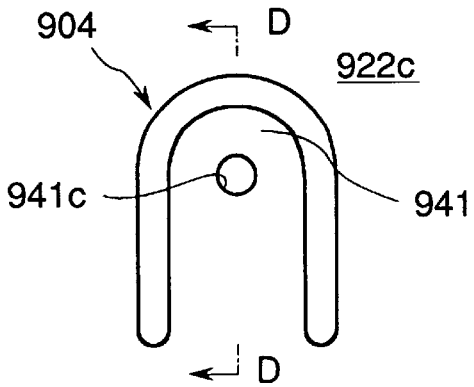
FIG. 23 is a plane view showing the principal portion of the embodiment.
Figure 24:
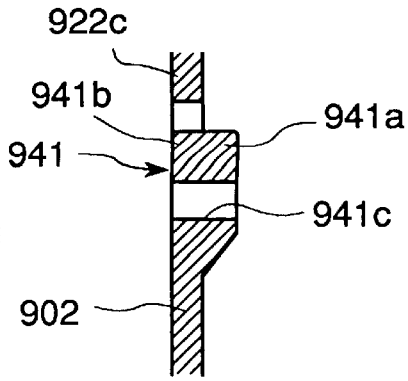
FIG. 24 is a sectional view taken along line D—D of FIG. 23.

Now referring to FIG. 22 through FIG. 24, the ninth embodiment of the invention will be described.

The ninth embodiment is different from the embodiment previously described in the engaging lock mechanism 904 and other arrangements are essentially the same as those of the first embodiment. Accordingly, the same reference number is given to the same element in the drawings and no description will be given.

Figure 22:
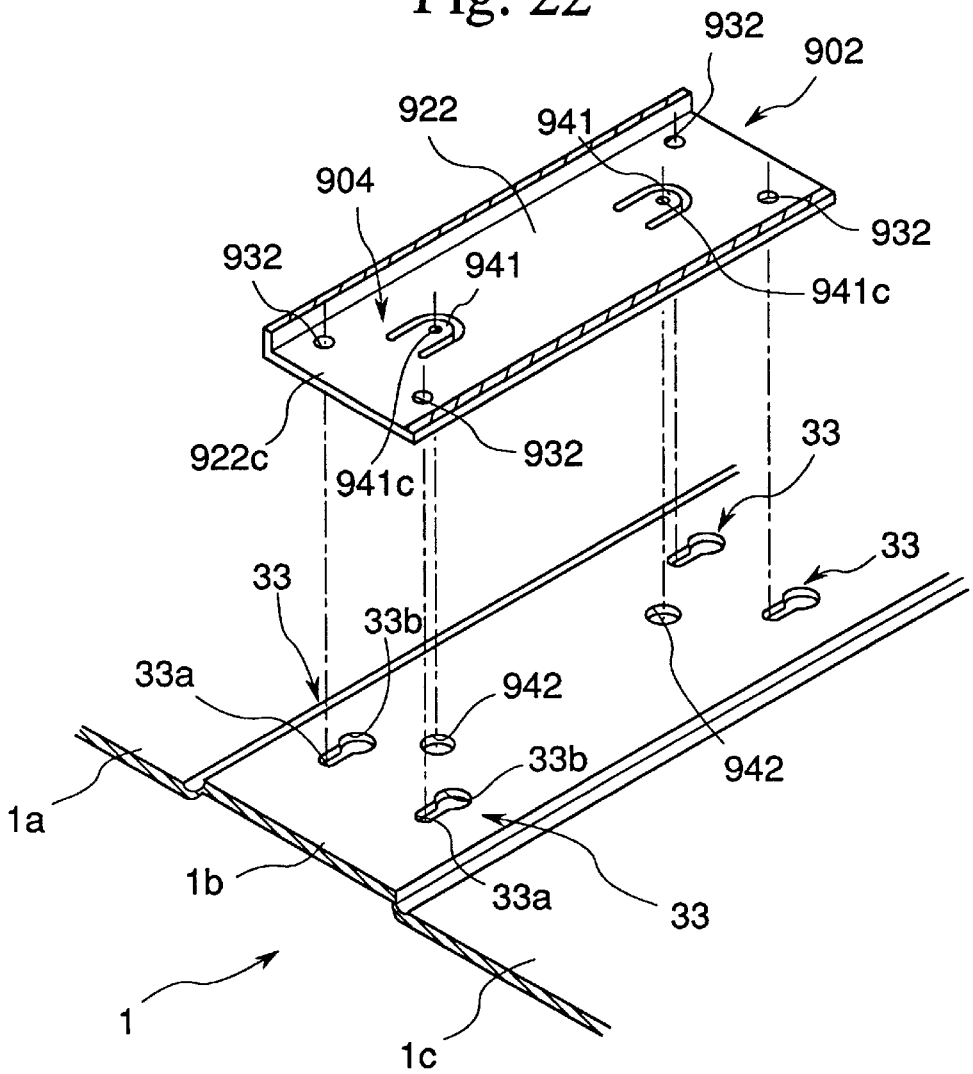
FIG. 22 is a perspective view showing the engaging lock mechanism in accordance with further embodiment of this invention.

The binding fastener 902 is of rigid synthetic resin and, as shown in FIG. 22, comprises a through hole 932 into which a rivet 31 is to be inserted and pass through and a stopper 941, both of which are provided on the mounting member 922*c* of the base member 922. The through hole 932 is a small circle-shaped hole having generally the same in diameter as the rivet 31 and is arranged at a location in the neighborhood of each of the four corners of the mounting member 922*c*. The engaging lock mechanism 904 comprises, as shown in FIG. 22 through 24, a locking hole 942 provided on the folder body 1 and an elastically transformable stopper 941 which is integrated with the binding fastener 902 of synthetic resin and at the tip of which provided is a thick portion 941*a* to be inserted into the above-mentioned locking hole 942.

More specifically, there are two stoppers 941, and each of the stoppers 941 is formed at the center of the width and at the neighborhood of upside or downside edge on the mounting member 922*c* and comprises a base portion 941*b* formed to be flat to the mounting member 922*c* and a thick portion 941*a* formed thicker on the side thereof facing the folder body 1 than the base portion 941*b* as much as the thickness of the folder body 1. The thick portion 941*a* is in a shape of semicircular and prohibits the binding fastener 902 from moving toward the big-circular portion 33*b* of the mounting hole 33 by making engagement with the locking hole 942 when the binding fastener 902 is mounted to the folder body 1. The base portion 941*b* of the stopper 941 has a release hole 941*c* for inserting a sliding rod or the like when it is necessary to elastically deform the stopper 941 upwardly. The release hole 941*c* is a shape of circular concentric with the stopper 541.

In accordance with the arrangement, the binding fastener 902 can be attached to or demounted from the folder body 1 as the same as the above-described embodiments. More specifically, for attaching the binding fastener 902 to the folder body 1, first bring the base member 922 into coincidence with the folder body 1 and align the center of the through hole 932 formed on the base member 922 with that of the small-circular portion 33*a* of the mounting hole 33 formed on the folder body 1 to make them concentric. When the alignment has been completed, the thick portion 941*a* of the stopper 941 comes into engagement with the locking hole 942, thereby to prohibit the binding fastener 902 from moving toward the big-circular portion 33*b* of the mounting hole 33. Next, insert each of the four rivets 31 into each small-circular portion 33*a* of the mounting hole 33 and the through hole 932. Finally, rivet the tip of the rivet 31 projecting from the through hole 932. For demounting the binding fastener 902 from the folder body 1 when the filing device becomes unnecessary, first plastically deform the stopper 941 upwardly along the base member 922 to release the engagement of the stopper 941 with the locking hole 542 by using a sliding rod or the like. Then the binding fastener 902 comes into a condition movable toward the big-circular portion 33*b* of the mounting hole 33. Next, move the binding fastener 902 relatively to the folder body 1 toward the big-circular portion 33*b* until the rivet 31 is brought into coincidence with the big-circular portion 33*b*. Then finally demount the binding fastener 902 from the folder body 1.

In accordance with the arrangement, although the binding fastener 902 is of synthetic resin, the same effects are produced as the above-mentioned embodiments in which the binding fastener is of metal.

Now referring to FIG. 2–5 through FIG. 27, the tenth embodiment of the invention will be described.

The tenth embodiment is different from the first embodiment in the engaging lock mechanism 1004 and other arrangements are essentially the same as those of the first embodiment. Accordingly, the same reference number is given to the same element in the drawings and no description will be given.

Figure 25:
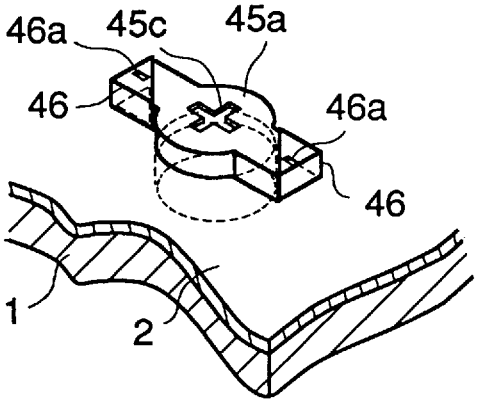
FIG. 25 is a perspective view showing the engaging lock mechanism in accordance with further embodiment of this invention.
Figure 26:
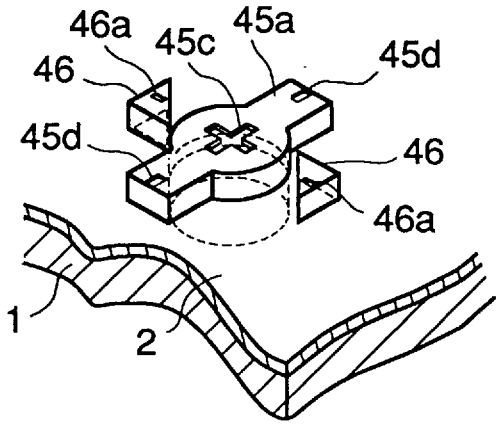
FIGS. 26 and 27 are explanatory views showing the function of the embodiment.
Figure 27:
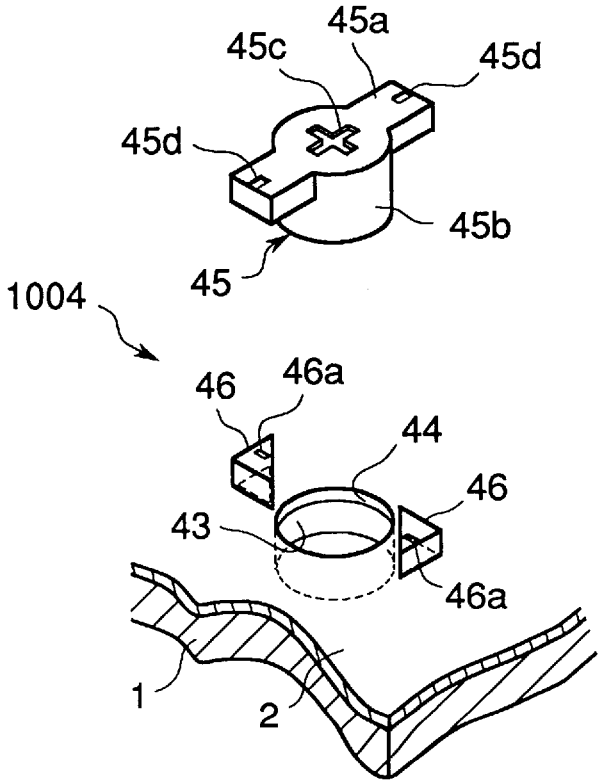

In the tenth embodiment, the engaging lock mechanism 1004, as shown in FIG. 25 through 27, comprises a locking hole 43 provided on the folder body 1, a through hole 44 provided on the binding fastener 2, a stopper 45 engaged with the locking hole 43 with a head portion 45*a* engaged with an opening edge of the through hole 44 and a leg portion 45*b* passed through the through hole 44 and a stopper engaging portion 46 which prohibits the stopper 45 from being pulled out by engaging with the head portion 45*a* when the stopper rotates. More specifically, in the engaging lock mechanism 1004 the stopper 45 is bolt-shaped and comprises the flat head portion 45*a* and the leg portion 45*b* projecting downward from the bottom of the head portion 45*a*. At the center of the head portion 45*a* provided is a concave 45*c* for engaging a screwdriver. At a location in the neighborhood of the edge of the head portion 45*a* provided is a concave 45*d* for preventing the head portion 45*a* from rotating. With the leg portion 45*b* of the stopper 45 inserted into and passed through the locking hole 43 formed on the folder body 1 and the through hole 44 formed on the binding fastener 2, the head portion 45*a* is engaged with the stopper engaging portion 46 formed on the binding fastener 2 by means of press molding or the like (as shown in FIG. 25). The downwardly projecting projection 46*a* formed on the stopper engaging portion 46 comes into engagement with the concave 45*d* and prevents the head portion 45*a* from being pulled out of the stopper engaging portion 46 by vibration or the like. As a result of this engagement of the head portion 45*a* with the stopper engaging portion 46, the stopper 45 is prohibited from moving upward along the binding fastener 2. In addition, as the leg portion 45*b* is inserted into both the locking hole 43 and the through hole 44, the binding fastener 2 is prevented from moving relatively to the folder body 1.

For removing the binding fastener 2, first engage the screwdriver with the concave 45*c* formed on the head portion 45*a* of the stopper 45. Then rotate the stopper 45 clockwise at least 90 degrees to release the engagement of the head portion 45*a* with the stopper engaging portion 46 (as shown in FIG. 26). When this engagement is released, lift the stopper 45 to completely draw the leg portion 45*b* out of the locking hole 43 and the through hole 44 (as shown in FIG. 27). This makes the binding fastener 2 and the folder body 1 free from the bolted condition by the leg portion 45*b*, resulting in a condition where the binding fastener 2 and the folder body 1 are relatively movable. Finally, demount the binding fastener 2 from the folder body 1 by moving the binding fastener 2 upward along the folder body 1 as the same as the above-mentioned embodiments. The stopper 45 may be applied to the above-mentioned embodiment as shown in FIG. 8, the embodiment as shown in FIG. 9, the embodiment as shown in FIG. 16 through 18, the embodiment as shown in FIG. 19 through 21, or the embodiment as shown in FIG. 28 and 29 to be described hereinafter.

Figure 28:
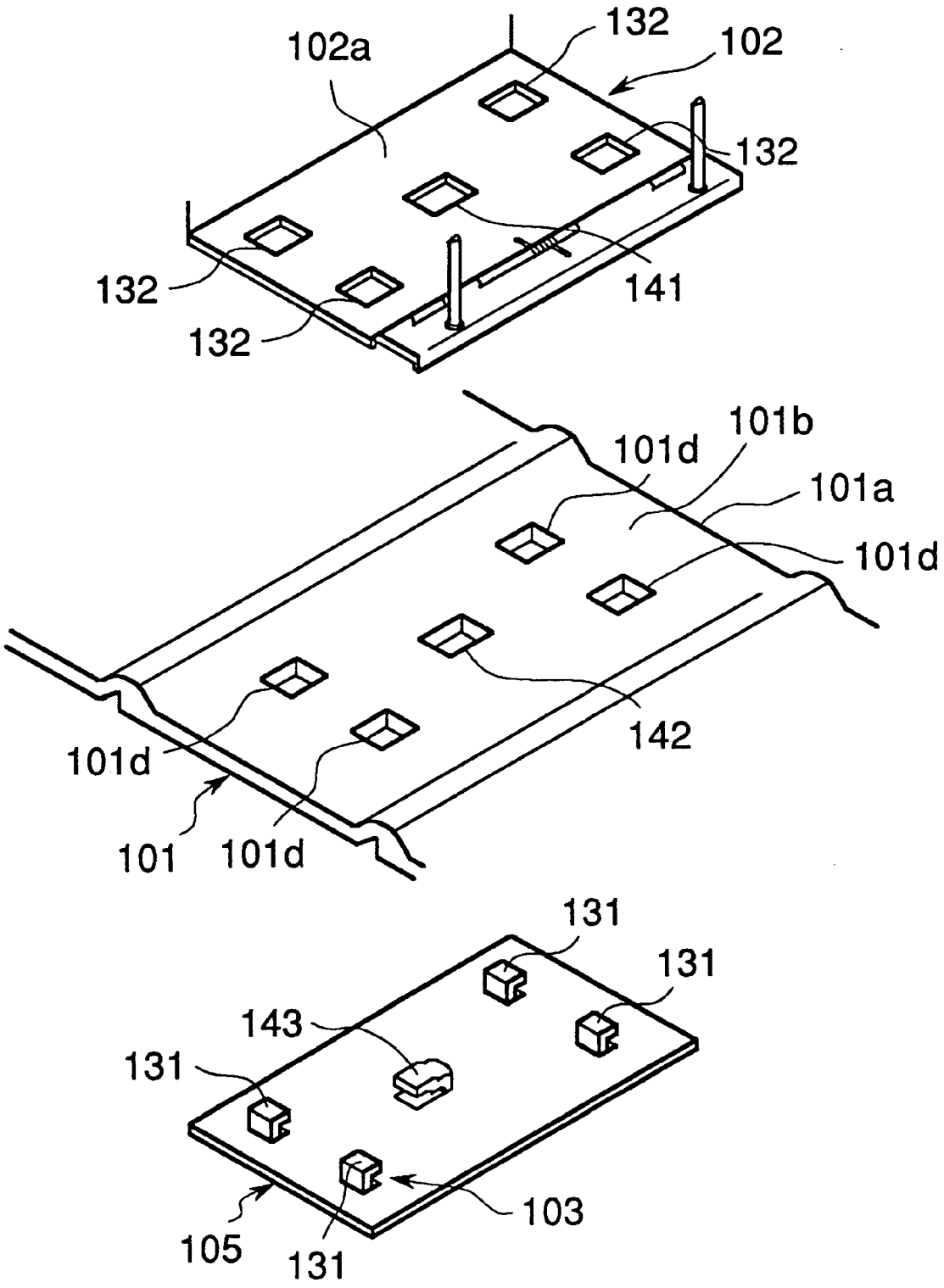
FIG. 28 is a perspective view showing the binding and engaging lock mechanisms in accordance with further embodiment of this invention.
Figure 29:
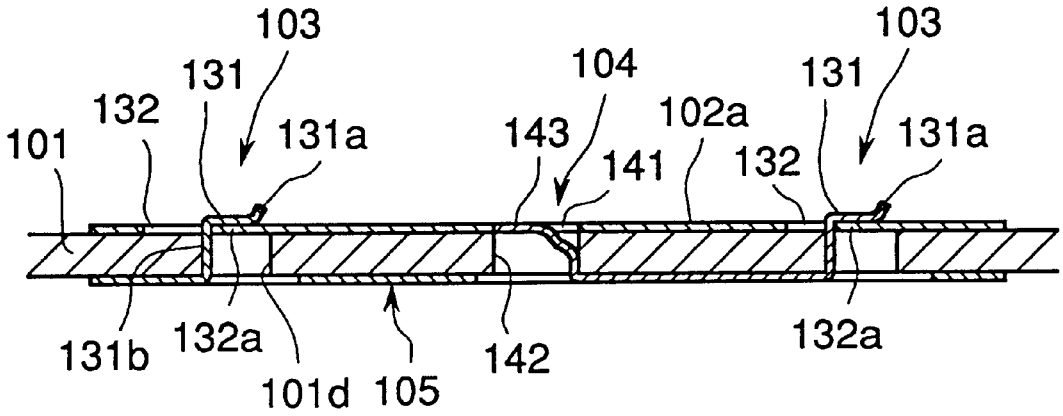
FIG. 29 is a sectional view showing the embodiment.

Referring to FIGS. 28 and 29, the eleventh embodiment will now be explained.

In the eleventh embodiment, the binding mechanism 103 comprises a bent member 131 which passes though the folder body 101 and projects from the inner face thereof and which is provided on a fixing plate 105 arranged along the outer face of the folder body 101, and an engaging hole 132 provided on the binding fastener 102. For attaching the binding fastener 102 to the folder body 101 at a predetermined position, first engage the bent member 131 with one edge 132*a* of the engaging hole 132 by moving the binding fastener 102 relatively to the folder body 1. Then hold the folder body 1 between the fixing plate 105 and the binding fastener 102.

The engaging lock mechanism 104 comprises a stopper engaging hole 141 provided on the binding fastener 102, a stopper through hole 142 provided on the folder body 101 at a corresponding position to the stopper engaging hole 141, and a stopper 143 which makes engagement with the stopper engaging hole 141 by passing through the stopper through hole 142 and which is provided on the fixing plate 105.

The fixing plate 105 is of sheet metal and having the same rectangular-shaped as the configuration of the base member 102*a*. The fixing plate 105 has the bent members 131 and each of which is formed by cutting near the corner of the fixing plate 105 to take an upright posture. The bent members 131 are bent parallel to the face of the fixing plate 105 at the height which totals the thicknesses of the folder body 101 and binding fastener 102 to face the same direction. The bent member 131 makes its tip portion 131*a* a little bent upward. Similarly the center of the fixing plate 105 is cut toward the opposite direction to the bent member 131 to form a stopper 143 which can make abutting engagement with both the inner face of the stopper through hole 142 and the inner face of the stopper engaging hole 141.

The back cover 101*b* of the folder body 101 is provided with a through hole 110*d* for the bent member 131 near the corner thereof at the position corresponding to the bent member 131. The engaging hole 132 is arranged on the base member 102*a* to be brought into coincidence with the through hole 101*d*. At the center of the base member 102*a* provided is the engaging hole 141 at the position corresponding to the stopper 143. The stopper through hole 142 is arranged on the folder body 101 to be brought into coincidence with the engaging hole 141. The through hole 110*d* is approximately the same in width as the bent member 131. The engaging hole 141 and the stopper through hole 142 is about the same in width as the stopper 143. As a result of these widths, the binding fastener 102 is free from slippage toward right or left when fixed to the folder body 101. The through hole 110*d* and the stopper through hole 142 are so formed on the folder body 101 that the stopper 143 closely attaches to the inner faces of the stopper through hole 142 and the through hole 101*d* with an upright portion 131*b* of the bent member 131 closely attached to the inner face of the through hole 101*d*.

With the above-mentioned arrangement, the binding fastener 102 is fixedly attached to the folder body 101 by the fixing plate 105. First put the fixing plate 105 to the outer face of the folder body 101. Next, insert the bent member 131 and the stopper 143 into the through hole 101*d* and the stopper through hole 142 respectively with the tip portion 131*a* of the bent member 131 faced to the upper edge 101*u* of the folder body 101 when the filing device is in use and the upright portion 131*b* closely adhered to the inner side of the through hole 101*d*. In this condition the stopper 143 is not inserted into the stopper engaging hole 141 while each of the bent members 131 is inserted into the engaging hole 132. Then move and slide the binding fastener 102 toward the down side of the folder body 101 with pushing the binding fastener 102 to the folder body 101. As a result of this sliding movement, the bent member 131 comes into engagement with the side edge 132*a* of the engaging hole 132 and the stopper 143 comes into engagement with the inner side of the stopper engaging hole 141 formed on the binding fastener 102 as well as the stopper through hole 142. As the binding fastener 102 is fixed with its bent member 131 facing to the upward when the filing fastener is in use, the weight acting on the binding fastener 102 is essentially sustained by four bent members 131.

In the eleventh embodiment, the binding fastener 102 is fixed to the folder body 101 with the bent member 131 engaged with the side edge 132*a* of the engaging hole 132 and the folder body 101 held between the binding fastener 102 and the fixing plate 105. When the filing device is to be disposed, release the engagement of the stopper 143 with the engaging hole 141 by bending the stopper 143 to fold toward the folder body 101, namely, the stopper through hole 142. As a result of this release, the binding fastener 102 is brought into a condition of slidably movable. Then move the binding fastener 102 to the direction to which the tip 131*a* of the bent member 131 faces. The bent member 131 is released from the engagement with the engaging hole 132. The bent member 131 can be positioned at the center of the engaging hole 132. Lift the binding fastener 102 at the position to demount it from the folder body 101. Accordingly, the binding fastener 102 can be demounted from the folder body 101 without plastically deforming or destroying the bent member 131 which substantially fixes the binding fastener 102 to the folder body 101.

Figure 30:
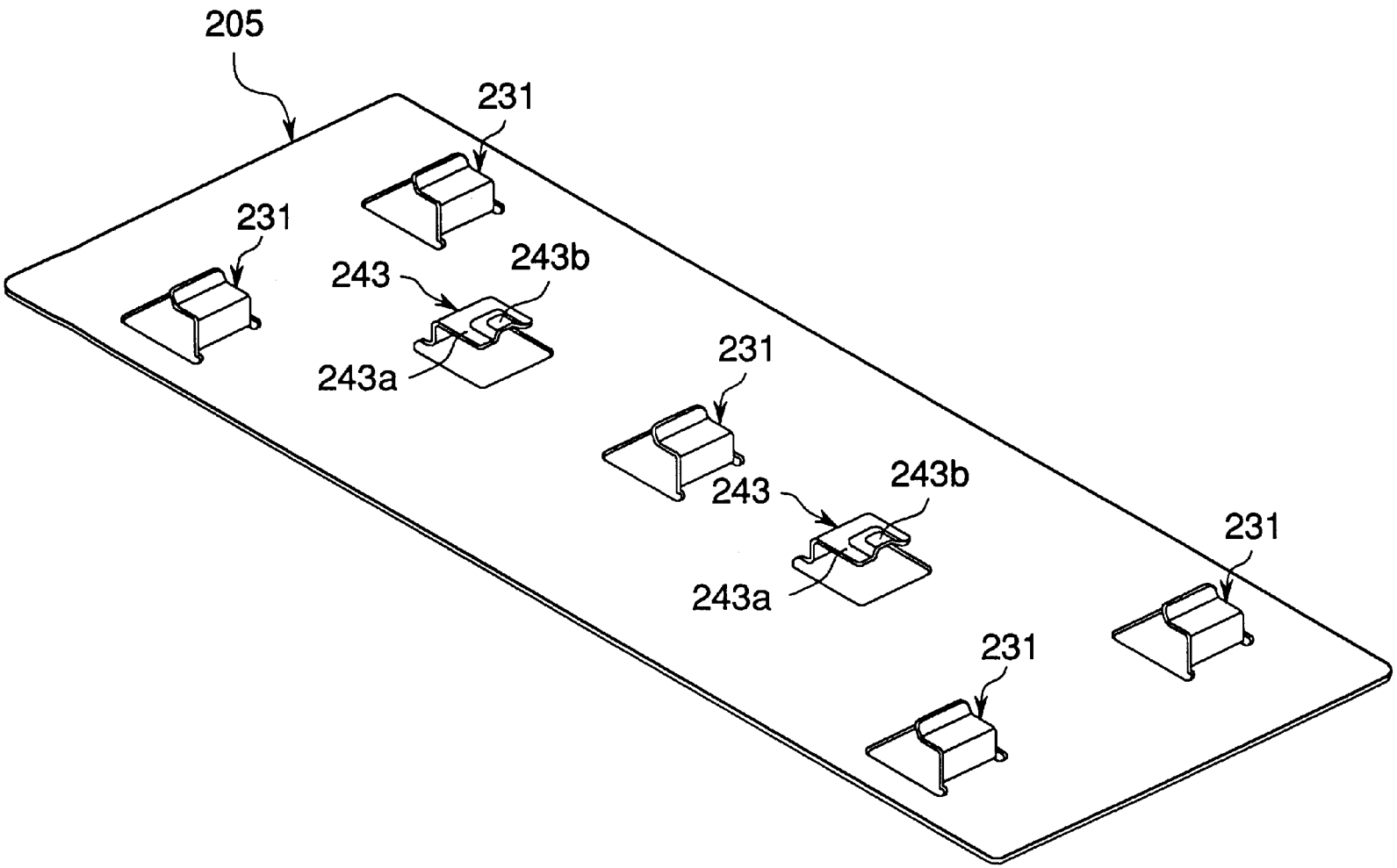
FIG. 30 is a perspective view showing the binding and engaging lock mechanisms in accordance with further embodiment of this invention.
Figure 31:
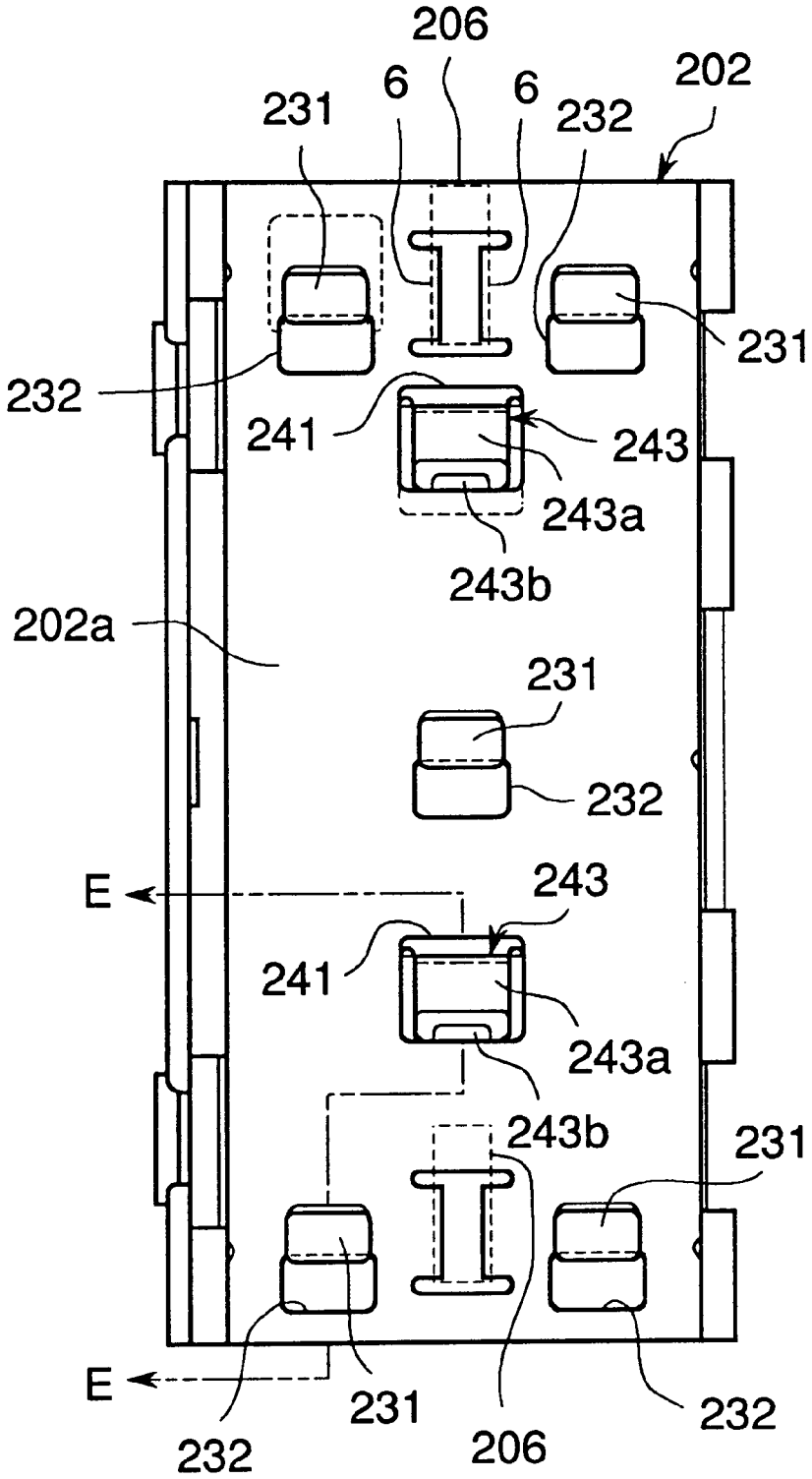
FIG. 31 is a plane view showing the embodiment.
Figure 32:
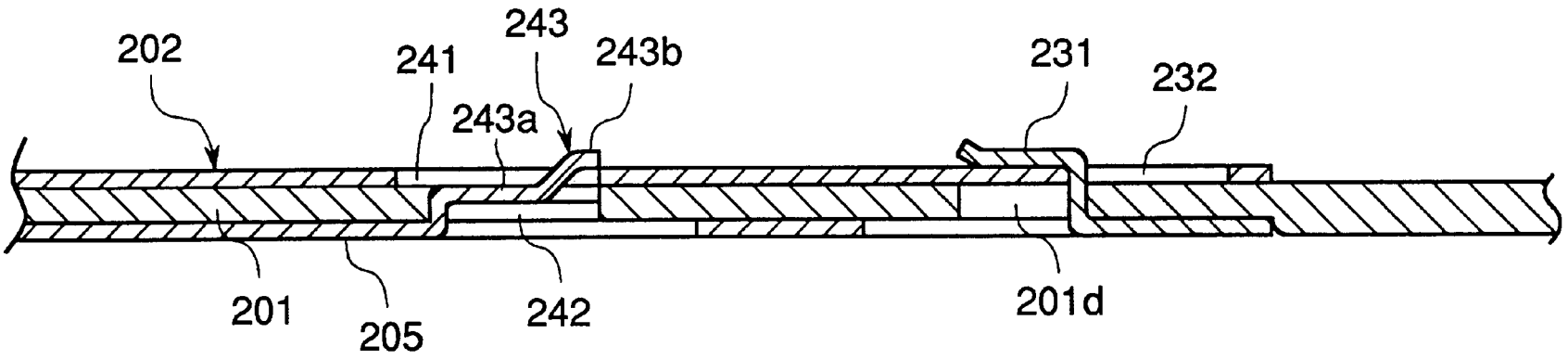
FIG. 32 is a sectional view taken along line E—E of FIG. 31.

Referring to FIG. 30 through FIG. 32, the twelfth embodiment will now be explained.

In the twelfth embodiment, the shape and the numbers of the bent member and the stopper formed on the fixing plate are different from those of the eleventh embodiment.

More specifically, there are five bent members 231 and two stoppers 243. Concretely, four of the bent members 231 are formed by cutting near each of the four corners on the fixing plate 205 like the eleventh embodiment and another one is formed on the center of the fixing plate 205. The two stoppers 243 are formed by cutting near upside and downside at the center in the width of the fixing plate 205. In this embodiment, the height of the horizontal portion 243*a* of the stopper 243 is generally the same as the thickness of the folder body 201. The center of the tip on the horizontal portion 243*a* is partially raised up to form the raised portion 243*b*, which makes engagement with the binding fastener 202. As a result of this raised portion 243*b* provided on the stopper 243, the whole height of the stopper 243, i.e. the height of the portion which projects from the inner face of the folder body 201 becomes lower, thereby to lessen the sliding resistance when the binding fastener 202 is bound to the folder body 201. As a result of this, it becomes easy to move the binding fastener 202. Needless to say, the folder body 201 and the binding fastener 202 are provided with the engaging holes 232, 241 and the through holes 201*d*, 242 corresponding to the bent members 231 and the stoppers 243.

In addition the binding fastener 202 in accordance with the embodiment has two travel-restraining members 6 formed by cutting the base member 202*a* and bending it downward at the center in the width of the base member 202*a* and outside to the stopper engaging hole 241 along the longitudinal length thereof to prohibit the binding fastener 202 from moving along the width. The travel-restraining member 6 has a hanging length less than the thickness of the folder body 201. Corresponding to the travel-restraining member 6 on the folder body 201 is formed an elongated hole 206 having generally the same in width as the distance between outer faces of the travel-restraining member 6. In accordance with the arrangement which prohibits the movement along the width, the bent member 231, the stopper 243, the engaging holes 232, 241, and the through holes 201*d*, 242 can have bigger clearance, thereby to make the processing of sheet metal easy.

Figure 33:
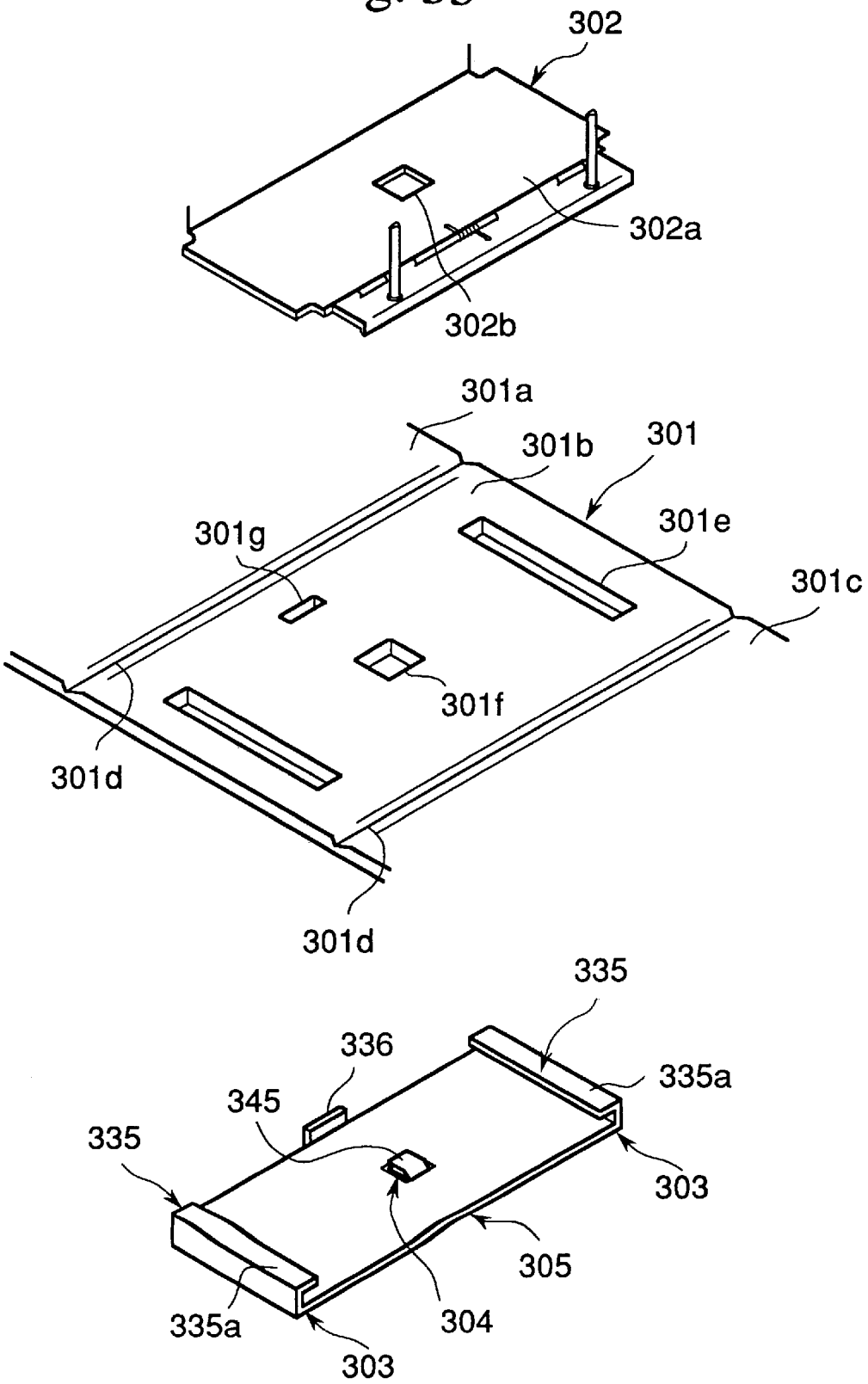
FIG. 33 is a perspective view showing the binding and engaging lock mechanisms in accordance with further embodiment of this invention.
Figure 34:
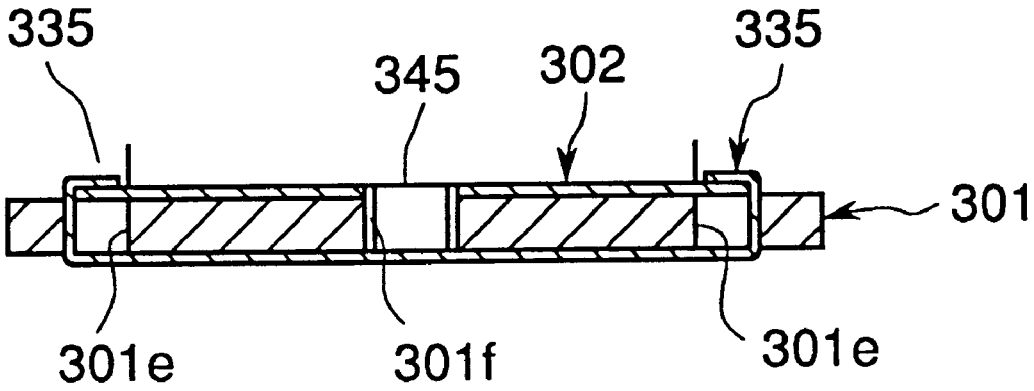
FIG. 34 is a sectional view showing the embodiment.

FIGS. 33 and 34 show the thirteenth embodiment of the invention.

In the thirteenth embodiment, the binding fastener 302 is fixedly attached to the folder body 301 by using the fixing plate 305 arranged along the outer face of the folder body 301. The folder body 301 is made of synthetic resin. Boundaries between the back and front covers 301*b*, 301*a* and the back and rear covers 301*b*, 301*c* are made thinner than the rest to form hinge sections 301*d* to facilitate opening and closing of the front and rear covers 301*a* and 301*c*.

The fixing plate 305 is rectangular-shaped and has a binding mechanism 303 and an engaging lock mechanism 304. The binding mechanism 303 comprises a pair of guide rails 335 as a guide holder provided on both up and down edges of the fixing plate 305 and which pass through the folder body 301 and project from the inner face thereof and an abutting member 336 which is provided on one longitudinal side of the fixing plate 305 and makes engagement with a through hole 301*g* of the folder body 301. The guide rails 335 are made by bending both sides of the fixing plate 305 of sheet metal to form channel shapes facing each other. The horizontal portion 335*a* of the guide rail 335 is formed so as to project from the inner face of the folder body 301 as much as a length that the base member 302*a* can be inserted into the folder body 301 from the inner face thereof when arranged along the folder body 301. The abutting member 336 is formed to have a height which can make engagement with the base member 302*a* to be engaged with the guide rail 335. The guide holder is not limited to the shape of continuous rail but may be a plurality of rail-shaped member provided spaced apart.

The engaging lock mechanism 304 in the fixing plate 305 is a stopper 345 provided by cutting a part of the fixing plate 505 as well as that of the twelfth embodiment. The stopper 345 faces to the side on which the abutting member 336 is formed and has a height of totaling the thicknesses of the folder body 301 and the base member 302*a*.

Corresponding to the fixing plate 305, on the back cover 301*b* of the folder body 301 provided are a through hole 301*e* oblong with more width than length into which the guide rail 335 is to be inserted, a stopper through hole 301*f* into which the stopper 345 is to be inserted, and a through hole 301*g* into which the abutting member 336 is to be inserted. In addition on the base member 302*a* provided is an engaging hole 302*b* corresponding to the stopper through hole 301*f* provided on the folder body 301.

With the arrangement, the binding fastener 302 is fixedly attached to the folder body 301 with both of the up and down edges thereof slidably engaged with the guide rail 335 of the fixing plate 305 and one side edge of the binding fastener 302 engaged with the abutting member 336. More specifically, first put the fixing plate 305 along the outer face of the folder body 301 with the guide rail 335 inserted into the oblong through hole 301*e*, stopper 345 into the stopper through hole 301*f*, and the abutting member 336 into the through hole 301g respectively. Next, insert the binding fastener 302 into the guide rail 335 from the other side of the fixing plate 305 where the abutting member 336 is provided and move and slide the binding fastener 302 along the guide rail 335 until the binding fastener 302 makes abutting engagement with the abutting member 336. As a result of this abutting engagement, the stopper 345 makes engagement with the engaging hole 302*b* of the binding fastener 302, thereby to prohibit the binding fastener 302 from moving the other end. Then the binding fastener 302 is fixedly attached to the folder body 301.

When the filing device is in use, the binding fastener 302 is supported by the guide rail 335 from the up and down sides and prohibited from moving along the direction of the thickness of the folder body 301, and is prohibited from moving left or right by the abutting member 336 and the stopper 345. Accordingly, the binding fastener 302 is kept to be fixedly attached to the folder body 301 like fixed by means of a rivet or the like. On the other hand, when the filing device is to be disposed, release the engagement of the stopper 345 with the engaging hole 302*b* by plastically deforming the stopper 345 toward the outer face of the folder body 301. The operation to bent the stopper 345 can be done easily with using a stick-shaped body such as a clamp member of the binding fastener 302 or a ballpoint pen or the like. As a result of the release of the engagement, the binding fastener 302 comes into a condition movable toward opposite to the abutting member 336 along the guide rail 335. Then move and slide the binding fastener 302 toward opposite to the abutting member 336, thereby to demount the binding fastener 302 from the folder body 301. In this embodiment, as the binding fastener 302 is bound to the fixing plate 305 by only the guide rail 335 and the stopper 345, the binding force which acts on the binding fastener 302 is quite small when it comes into a movable condition compared to the strength with which the folder body 301 is bound to the binding fastener 302 by rivets. As a result of this, small force will do to move the binding fastener 302. In addition, as the folder body 301 is strengthened by the fixing plate 305 attached to the back cover 301*b* thereof, the folder body 301 of synthetic resin can have generally the same rigidity as that of cardboard.

This invention is not limited to the embodiments described in detail hereinabove. In each of the above-mentioned embodiments, the folder body is explained as of paper, but may be of polypropylene or rigid vinyl chloride. In addition, the folder body is explained as comprising the front cover, the back cover and the rear cover, but may comprise one board such as a paper clip or a clip board. In this case, the position at which the binding fastener may be the same as the conventional one.

The arrangement of the binding fastener may be applied to a ring type such as a loose-leaf type, so called a Z-type where papers are held between a clamp member and a base member supporting the clamp member with the clamp member manipulated by a lever, or other types which are well-known in the art in addition to the above-described type where the clamp member having a sliding rod is removably held by a pipe-shaped binding rod mounted to a base member. Further, the binding fastener may be attached to the rear cover near the boundary to the back cover in addition to the back cover.

The arrangement of the invention is not limited to the drawings, but other modifications can be applied without departing from the spirit of the invention.

POSSIBLE APPLICATIONS IN INDUSTRY

As explained in detail hereinabove, the filing device of the invention is suitable for use as an environment conscious filing device which makes it easy to be separated and collected according to the material with considering reuse of the resource when disposed.

I claim:

1. A filing device in which a binding fastener fixedly attached to a folder body can be demounted from the folder body when a part of the filing device is plastically deformed or destroyed, and is characterized by that said binding fastener is fixedly attached to the folder body by a binding mechanism which fastens the binding fastener to the folder body and which enables the binding fastener to be released from the folder body by a relative movement of the binding fastener to the folder body, and an engaging lock mechanism which prohibits said relative movement, and that the engaging lock mechanism comprises a locking hold provided on the folder body, and a stopper provided on the binding fastener with its front bent portion inserted into the locking hole, wherein the binding fastener is put into a condition in which the binding fastener can be released from the folder body by plastically deforming or destroying said stopper.

2. The filing device according to claim 1, wherein said binding mechanism comprises a mounting hole provided on either one of the folder body or the binding fastener and having a small-circular portion and a big-circular portion continuously to the small-circular portion, a through hole provided on the other and having a diameter corresponding to said small-circular portion, and a rivet inserted into and passing through both said through hole and the small-circular portion of the mounting hole.

3. The filing device according to claim 1, wherein the binding mechanism comprises a mounting hole formed on either one of the folder body or the binding fastener and having a rivet through portion and a cross slit portion which is arranged continuous to said rivet through portion, a through hole provided on the other and having a diameter corresponding to that of the rivet through portion, and a rivet inserted into and passing through both the through hole and the rivet through portion of the mounting hole.

4. The filing device according to claim 1, wherein the binding mechanism comprises a hook-shaped bent portion provided either one of the folder body or the binding fastener, and an engaging hole provided on the other, in which the hook-shaped bent portion inserted into the engaging hole is brought into engagement with an opening edge of the engaging hole by the relative movement of the folder body to the binding fastener.

5. The filing device according to claim 1, wherein the binding mechanism comprises a bent member passing through the folder body and projecting from the inner face thereof and which is provided on a fixing plate arranged along the outer face of the folder body, and an engaging hole provided on the binding fastener, in which the bent member is brought into engagement with an edge of the engaging hole by the relative movement of the folder body to the binding fastener.

6. The filing device according to claim 1, wherein the binding mechanism comprises a pair of guide holders passing through the folder body and projecting from the inner face thereof and which is provided on both up and down edges of the fixing plate arranged along the folder body, and an abutting member passing through the folder body and projecting from the inner facet hereof and which is provided on one longitudinal side of the fixing place, in which one side edge of the binding fastener whose up and down edges are slidably engaged with said guide holders is brought into engagement with said abutting member.

7. The filing device according to claim 1, wherein the stopper comprises a generally semicircular free end and a front bent portion of curved-wall-shaped which is elongated from the edge of said semicircular free end.

8. A filing device in which a binding fastener fixedly attached to a folder body can be demounted from the folder body when a port of the filing device is plastically deformed or destroyed, and is characterized by that said binding fastener is fixedly attached to the folder body by a binding mechanism which fastens the binding fastener to the folder body and which enables the binding fastener to be released from the folder body by a relative movement of the binding fastener to the folder body, and an engaging lock mechanism which prohibits said relative movement, and that the engaging lock mechanism comprises a locking hole provided on the folder body, and an elastically transformable stopper which is integrated with the binding fastener of synthetic resin and at its tip of which provided is a thick portion to be inserted into said locking hole, wherein the binding fastener is put into a condition in which the binding fastener can be released from the folder body by plastically deforming or destroying said stopper.

9. A filing device in which a binding fastener fixedly attached to a folder body can be demounted from the folder body when a part of the filing device is plastically deformed or destroyed, and is characterized by that said binding fastener is fixedly attached to the folder body by a binding mechanism which fastens the binding fastener to the folder body and which enables the binding fastener to be released from the folder body by a relative movement of the binding fastener to the folder body, and an engaging lock mechanism which prohibits said relative movement, wherein the engaging lock mechanism comprises a locking hole provided on the folder body, a through hole provided on the binding fastener, a stopper engaged with the locking hole with a head portion hereof locked with an opening edge of the through hole and with a leg portion passing through the through hole, and a stopper engaging portion which prohibits the stopper from being pulled out by engaging with the head portion when the stopper rotates.

10. The filing device according to claim 3, wherein the engaging lock mechanism comprises an engaging hole provided on the binding fastener, a through hole provided on the folder body corresponding to said engaging hole, and a stopper provided on the fixing plate and which makes engagement with the engaging hole by passing the through hole.

11. The filing device according to claim 4, wherein the engaging lock mechanism comprises an engaging hole provided on the binding fastener, a through hole provided on the folder body corresponding to said engaging hole, and a stopper provided on the fixing plate and which makes engagement with the engaging hole by passing the through hole.

12. The filing device according to claim 8, wherein said binding mechanism comprises a mounting hole provided on either one of the folder boy or the binding fastener and having a small-circular portion and a big-circular portion continuously to the small-circular portion, a through hole provided on the other and having a diameter corresponding to said small-circular portion, and a rivet inserted into and passing through both said through hole and the small-circular portion of the mounting hole.

13. The filing device according to claim 9, wherein said binding mechanism comprises a mounting hole provided on either one of the folder body or the binding fastener and having a small-circular portion and a big-circular portion continuously to the small-circular portion, a through hole provided on the other and having a diameter corresponding to said small-circular portion, and a rivet inserted into and passing through both said through hole and the small-circular portion of the mounting hole.

* * * * *